US009375970B2

(12) United States Patent
Kizaki et al.

(10) Patent No.: US 9,375,970 B2
(45) Date of Patent: Jun. 28, 2016

(54) IMAGE FORMING APPARATUS CONFIGURED TO MODIFY A BOOKBINDING OPERATION BASED ON A MAXIMUM NUMBER OF BINDABLE SHEETS, IMAGE FORMING METHOD, COMPUTER PROGRAM PRODUCT, AND STORAGE MEDIUM HAVING RECORDED THE COMPUTER PROGRAM PRODUCT CONFIGURED TO PERFORM SAME

(71) Applicants: Osamu Kizaki, Saitama (JP); Satoshi Hatanaka, Kanagawa (JP); Kohichi Irie, Kanagawa (JP)

(72) Inventors: Osamu Kizaki, Saitama (JP); Satoshi Hatanaka, Kanagawa (JP); Kohichi Irie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 391 days.

(21) Appl. No.: 13/914,984

(22) Filed: Jun. 11, 2013

(65) Prior Publication Data

US 2013/0336746 A1 Dec. 19, 2013

(30) Foreign Application Priority Data

Jun. 18, 2012 (JP) ..... 2012-137244

(51) Int. Cl.

| | |
|---|---|
| ***B65H 37/04*** | (2006.01) |
| ***B42C 99/00*** | (2006.01) |
| ***B42B 4/00*** | (2006.01) |

(Continued)

(52) U.S. Cl.

CPC . *B42C 99/00* (2013.01); *B42B 4/00* (2013.01); *B42C 1/12* (2013.01); *B65H 37/04* (2013.01); *G03G 15/6544* (2013.01); *B65H 2301/1635* (2013.01); *B65H 2301/51611* (2013.01); *B65H 2801/27* (2013.01); *G03G 2215/00936* (2013.01)

(58) Field of Classification Search

CPC ..... G03G 15/6541; G03G 15/6544; G03G 2215/00827; G03G 2215/00936; G03G 2215/00869; B65H 2301/1635; B65H 2301/51611; B42C 1/12

See application file for complete search history.

(56) References Cited

U.S. PATENT DOCUMENTS

| | | | |
|---|---|---|---|
| 5,434,650 | A | 7/1995 | Nakahara et al. |
| 5,485,246 | A | 1/1996 | Hayashi et al. |
| 5,510,876 | A | 4/1996 | Hayashi et al. |

(Continued)

FOREIGN PATENT DOCUMENTS

| | | |
|---|---|---|
| JP | 03-153393 | 7/1991 |
| JP | 04-101895 | 4/1992 |

(Continued)

*Primary Examiner* — Justin Olamit

(74) *Attorney, Agent, or Firm* — Harness, Dickey & Pierce, P.L.C.

(57) ABSTRACT

An image forming apparatus is disclosed. The image forming apparatus includes a detecting unit which detects the number of manuscript sheets; a calculating unit which calculates the anticipated number of sheets of recording media based on the detected number of sheets; a determining unit which determines whether the anticipated number of sheets calculated exceeds the predetermined number of sheets; and a bookbinding unit which binds multiple recording media, wherein the calculating unit calculates the anticipated number of sheets, further including a cover arranged on the outside of the multiple recording media which are stacked in an overlapping manner, and wherein the bookbinding unit binds multiple recording media without arranging the cover on the outside of the multiple recording media when an image is not formed on the cover if the determining unit determines that the anticipated number of sheets exceeds the predetermined number of sheets.

8 Claims, 18 Drawing Sheets

(51) Int. Cl.
*B42C 1/12* (2006.01)
*G03G 15/00* (2006.01)

(56) References Cited

U.S. PATENT DOCUMENTS

| | | | | |
|---|---|---|---|---|
| 5,546,164 | A | 8/1996 | Hayashi et al. | |
| 5,583,615 | A | 12/1996 | Hashimoto et al. | |
| 5,621,221 | A | 4/1997 | Shinohara et al. | |
| 5,694,201 | A | 12/1997 | Hayashi et al. | |
| 5,737,665 | A | 4/1998 | Sugiyama et al. | |
| 5,740,492 | A | 4/1998 | Deki et al. | |
| 5,784,663 | A | 7/1998 | Hayashi et al. | |
| 5,805,192 | A | 9/1998 | Sasaki et al. | |
| 5,812,900 | A | 9/1998 | Hashimoto et al. | |
| 5,897,236 | A | 4/1999 | Hashimoto et al. | |
| 5,899,597 | A | 5/1999 | Shinohara et al. | |
| 5,915,156 | A | 6/1999 | Kizaki et al. | |
| 5,966,564 | A | 10/1999 | Kizaki et al. | |
| 6,026,255 | A | 2/2000 | Kizaki et al. | |
| 6,118,557 | A | 9/2000 | Sugiyama et al. | |
| 6,122,457 | A | 9/2000 | Kizaki | |
| 7,263,328 | B2 * | 8/2007 | Asai | B42C 19/02 101/484 |
| 7,307,750 | B2 | 12/2007 | Kizaki | |
| 7,369,256 | B2 | 5/2008 | Kizaki | |
| 7,515,293 | B2 | 4/2009 | Kizaki et al. | |
| 7,586,639 | B2 * | 9/2009 | Nakata | G06F 3/1208 358/1.15 |
| 7,595,903 | B2 | 9/2009 | Kizaki et al. | |
| 7,782,473 | B2 | 8/2010 | Kizaki et al. | |
| 7,904,831 | B2 | 3/2011 | Kizaki | |
| 8,177,214 | B2 * | 5/2012 | Sato | B42B 4/00 270/52.18 |
| 2003/0035142 | A1 | 2/2003 | Kizaki | |
| 2004/0109186 | A1 | 6/2004 | Shindoh et al. | |
| 2004/0114171 | A1 | 6/2004 | Shindoh et al. | |
| 2004/0136022 | A1 | 7/2004 | Kizaki et al. | |
| 2004/0233466 | A1 | 11/2004 | Shindoh et al. | |
| 2006/0075362 | A1 | 4/2006 | Moteki et al. | |
| 2007/0098429 | A1 * | 5/2007 | Hayashi | G03G 15/5016 399/82 |
| 2008/0049242 | A1 * | 2/2008 | Kimura | H04N 1/00222 358/1.12 |
| 2008/0174825 | A1 * | 7/2008 | Hatakeyama | B42C 11/04 358/1.18 |

FOREIGN PATENT DOCUMENTS

| | | |
|---|---|---|
| JP | 04-185384 | 7/1992 |
| JP | 04-368891 | 12/1992 |
| JP | 2001-030584 | 2/2001 |

* cited by examiner

IMAGE FORMING APPARATUS CONFIGURED TO MODIFY A BOOKBINDING OPERATION BASED ON A MAXIMUM NUMBER OF BINDABLE SHEETS, IMAGE FORMING METHOD, COMPUTER PROGRAM PRODUCT, AND STORAGE MEDIUM HAVING RECORDED THE COMPUTER PROGRAM PRODUCT CONFIGURED TO PERFORM SAME

TECHNICAL FIELD

The present invention relates to image forming apparatuses and image forming methods.

BACKGROUND ART

Image forming apparatuses include those which are provided with a function of, after forming images on multiple recording media, binding the multiple recording media (for example, a bookbinding function).

Patent Document 1 discloses a recording control apparatus (an image forming apparatus) which compares the number of sheets of paper (recording media) to undergo a stapling process (a bookbinding process) with a predetermined limit number of sheets to determine whether a stapling process can be performed, and, if yes, carry out the stapling process.

PATENT DOCUMENT

Patent Document 1 JP04-101895A

With a technique disclosed in Patent Document 1, there may be a case such that, when the number of sheets of multiple recording media on which images are formed exceeds the number of sheets up to which the stapling process may be carried out, the multiple recording media may not be bound in one bundle.

DISCLOSURE OF THE INVENTION

An object of the present invention is to provide an image forming apparatus which makes it possible to bind recording media in one bundle by decreasing the number of sheets of the recording media when the number of sheets of the recording media that is calculated based on the number of manuscript sheets exceeds the number of sheets which can be bound in one bundle.

According to an embodiment of the present invention, an image forming apparatus is provided, including: a detecting unit which detects the number of manuscript sheets on which an image is formed; a calculating unit which calculates the anticipated number of sheets of recording media on which the image is formed based on the detected number of sheets; a determining unit which determines whether the anticipated number of sheets calculated exceeds the predetermined number of sheets; and a bookbinding unit which binds multiple recording media on which the image is formed, wherein the calculating unit calculates the anticipated number of sheets, further including a cover arranged on the outside of the multiple recording media which are stacked in an overlapping manner, and wherein the bookbinding unit binds multiple recording media without arranging the cover on the outside of the multiple recording media when the image is not formed on the cover if the determining unit determines that the anticipated number of sheets exceeds the predetermined number of sheets.

An image forming apparatus according to the present invention makes it possible to bind recording media in one bundle by decreasing the number of sheets of recording media that is calculated based on the number of manuscript sheets when the number of sheets of the recording media exceeds the number of sheets which can be bound in one bundle.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Embodiments will be given below with reference to the attached drawings for explaining the best mode for carrying out the present invention.

The present invention is explained using an image forming apparatus which forms an image on a recording medium. The present invention may be used for any one in which multiple recording media on which an image (a character, a diagram, a figure, etc.) are formed (transferred, copied, depicted, etc.), other than a below-described image forming apparatus. Here, one which performs post-processing includes a bookbinding apparatus, a stapling apparatus, a printer, a scanner, a copying machine, a fax/facsimile machine, etc. Moreover, post-processing includes processing such as binding, stapling, bookbinding, stitching, sorting, stacking, loading, etc.

The recording medium on which post-processing may be performed using an image forming apparatus according to the present invention includes plain paper, wood free paper, thin paper, thick paper, recording paper, coat paper, an OHP sheet, synthetic resin film, and any other one, on which surface an image may be formed.

(Configuration of Image Forming Apparatus)

Figure 1:
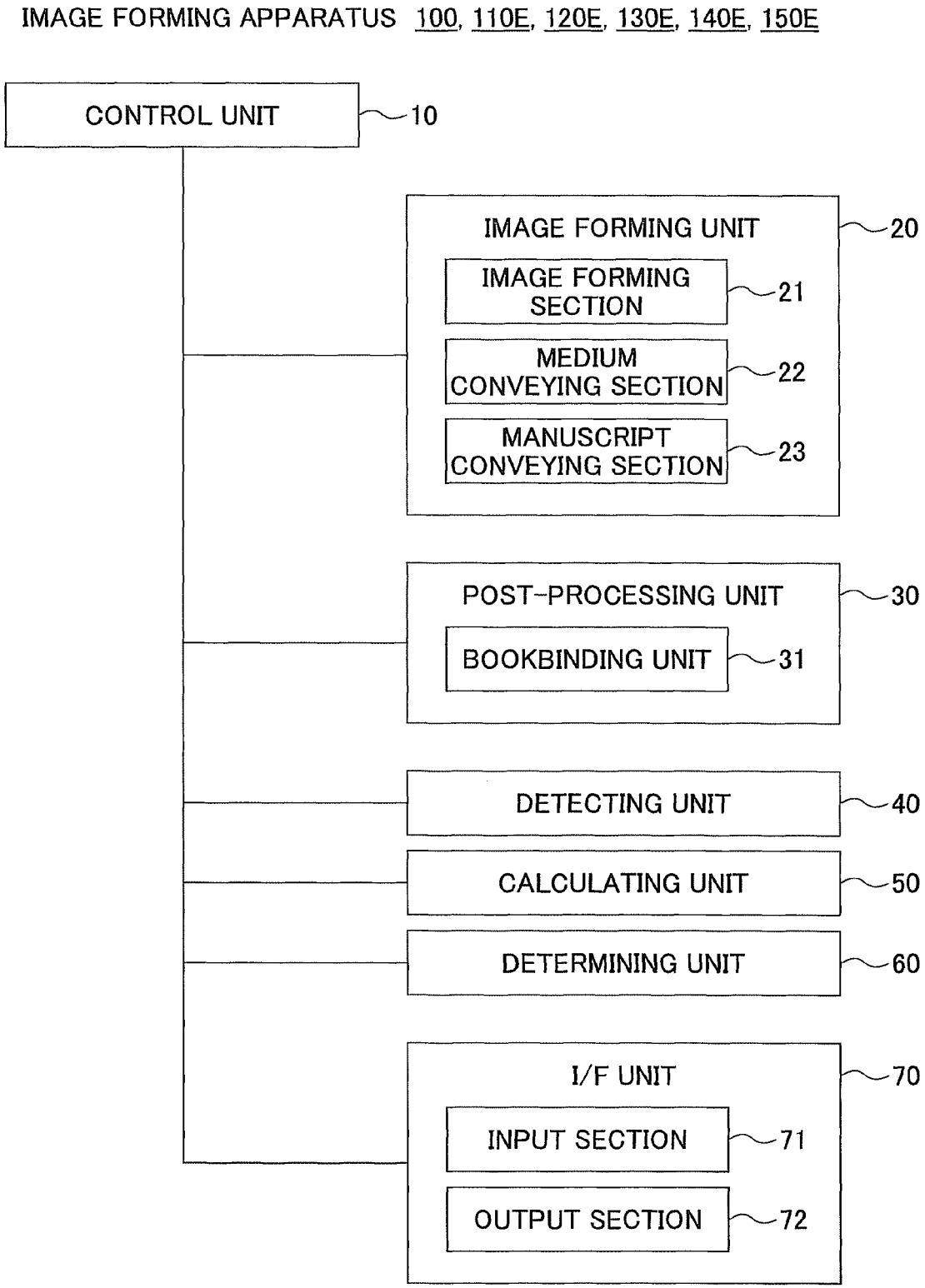
FIG. 1 is a schematic configuration diagram illustrating one example of an image forming apparatus according to an embodiment of the present invention.

Using FIG. 1, a configuration of an image forming apparatus 100 according to an embodiment of the present invention is explained.

The image forming apparatus 100 according to the present embodiment makes it possible to use an image forming unit 20 to form an image on a recording medium. Moreover, the image forming apparatus 100 according to the present embodiment makes it possible to use a post-processing unit 30 to perform post-processing (for example, stapling, bookbinding, sorting, etc.) on the multiple recording media on which the image is formed.

As shown in FIG. 1, the image forming apparatus 100 according to the present embodiment includes a control unit 10 which controls an operation of each element of the image forming apparatus 100; an image forming unit 20 which forms an image on a recording medium based on a manuscript; and a post-processing unit 30 which performs post-processing on the recording medium on which the image is formed. Moreover, the image forming apparatus 100 includes a detecting unit 40 which detects the number of manuscript sheets; a calculating unit 50 which calculates the number of sheets of the recording medium on which an image is formed based on the number of manuscript sheets (the below-described anticipated number of sheets); and a determining unit 60 which determines whether the number of sheets calculated exceeds the predetermined number of sheets (described below). Furthermore, the image forming apparatus 100 includes an I/F unit 70 which inputs and outputs information with the outside of the image forming apparatus 100.

The control unit 10 is a unit which instructs an operation to respective elements of the image forming apparatus 100 and controls the operation of the respective elements. The control unit 10 may control an operation of the image forming unit 20, etc., using programs, etc., which are pre-stored. Moreover, the control unit 10 may control an operation of the image forming unit 20, etc., based on information, etc., input from the I/F unit 70 (an input section 71, etc.). Furthermore, the control unit 10 may output information on a state of the image forming apparatus 10 using the I/F unit 70 (an output section 72, etc.).

The control unit 10 according to the present embodiment makes it possible to control an operation of the image forming unit 20 forming an image onto the recording medium. Moreover, the control unit 10 according to the present embodiment makes it possible to control an operation of the post-processing unit 30 performing post-processing on the image formed recording medium. Furthermore, the control unit 10 according to the present embodiment makes it possible to control an operation of the detecting unit 40 detecting the number of manuscript sheets; an operation of the calculating unit 50 calculating the anticipated number of sheets of the image formed recording media; and an operation of the determining unit 60 determining whether the anticipated number of sheets exceeds the predetermined number of sheets.

The control unit 10 may be configured to include a storage section which stores information, etc. The control unit 10 may use the storage section to store operating conditions and programs (a control program, an application, etc.) which are required for operating the image forming apparatus 100, for example. Moreover, the control unit 10 may use the storage section to store, for example, information on processing of the image forming apparatus 100 (detection results detected by the detecting unit 40; calculation results calculated by the calculating unit 50; and determination results determined by the determining unit 60, for example). Here, known techniques (a hard disk, a memory, a ROM, a RAM, etc.) may be used for the storage section.

The image forming unit 20 is a unit which forms an image on the recording medium. The image forming unit 20 according to the present embodiment includes an image forming section 21 which forms the image on the recoding medium; a medium conveying section 22 which conveys the recording medium; and a manuscript conveying section 23 which conveys a manuscript on which the image, etc., is recorded (formed).

The image forming unit 20 according to the present embodiment makes it possible to use the manuscript conveying section 23 to obtain image data on the image formed (data on content recorded in the manuscript). The image forming unit 20 according to the present embodiment makes it possible to use the image forming section 21 to form an image on the recording medium based on image data obtained. Moreover, the image forming unit 20 according to the present embodiment makes it possible to use the medium conveying section 22 to convey (carry in (feed) and carry out (discharge)) the recording medium before and after image forming.

The post-processing unit 30 is a unit which performs post-processing on the recording medium on which the image is formed. The post-processing unit 30 according to the present embodiment includes a bookbinding unit 31 which binds multiple recording media in a bundle (below called "performs bookbinding").

The bookbinding unit 31 is a unit which performs bookbinding on the image formed recording medium. The bookbinding unit 31 according to the present embodiment makes it possible to staple (fasten with a wire, etc., for bookbinding) a portion of image formed multiple recording media (for example, upper left, a left edge portion, lower left, a central portion, upper right, a right edge portion, lower right, etc.). Moreover, the bookbinding unit 31 according to the present embodiment makes it possible, for protection, content display, and/or decoration of the multiple recording media which are loaded in an overlapping manner, to arrange paper sheets which cover multiple recording media (below called "a cover") on the outside of the multiple recording media to perform bookbinding on the arranged paper sheets.

Furthermore, the bookbinding unit 31 according to the present embodiment makes it possible to perform bookbinding in which, in order to categorize multiple image formed recording media to bind the categorized recording media, the top of categories to be categorized are jogged on one surface of the recording media ("chapter divided"). Moreover, the bookbinding unit 31 according to the present embodiment makes it possible to perform bookbinding in which, in order to categorize multiple image formed recording media to bind the categorized recording media, a different recording medium (below called "joined paper") is placed between the multiple image formed recording media (below called "chapter broken") to perform bookbinding.

The post-processing unit 30 may also be configured to include a unit which sorts, pastes and otherwise processes, after image forming, the recording media.

The detecting unit 40 is a unit which detects the number of manuscript sheets on which the image is formed. The detecting unit 40 according to the present embodiment makes it possible to detect the number of manuscript sheets (below called "the number of manuscript sheets NSc") using a manuscript detecting section (for example, a manuscript set detecting section 407) which is arranged in an automatic manuscript sending apparatus (for example, an ADF). Moreover, the detecting unit 40 according to the present embodiment makes it possible to detect (obtain) (information on) the number of manuscript sheets NSc using information input by the below-described input section 71 (the I/F unit 70). A method of the detecting unit 40 detecting the number of manuscript sheets NSc is not limited to the above-described method. In other words, the detecting unit 40 may use a different known technique to detect the number of manuscript sheets.

The calculating unit 50 is a unit which calculates the number of recording media on which an image is formed. The calculating unit 50 according to the present embodiment makes it possible to calculate (estimate) the number of image formed recording media (below called "the anticipated number of sheets NSa") based on the number of manuscript sheets NSc that is detected by the detecting unit 40. Moreover, the calculating unit 50 according to the present embodiment makes it possible to calculate (estimate) the anticipated number of sheets NSa using information input by the below-described input section 71 (the I/F unit 70). Furthermore, the calculating unit 50 according to the present embodiment makes it possible to calculate (estimate) the anticipated number of sheets NSa based on modes for image forming on the recording media (for example, double-sided (double-sided printing), single-sided (single-sided printing), aggregate (reduce/enlarge), and other printing modes). For example, for image forming on the recording media in aggregate, for example, the calculating unit 50 may calculate (estimate) the number of image formed recording media (the number of sheets at a time of aggregating NSi) as the anticipated number of sheets NSa.

The determining unit 60 is a unit which determines whether the multiple image-formed recording media may be bound in a bundle. The determining unit 60 according to the present embodiment may determine whether the multiple recording media may be bound in a bundle by determining whether the anticipated number of sheets NSa calculated by the calculating unit 50 exceeds a predetermined number of sheets NSp (the number of sheets on which bookbinding processing is possible in a bundle). Moreover, the determining unit 60 according to the present embodiment may determine whether multiple recording media may be bound in a bundle further using specifications (for example, the number of sheets, paper thickness, quality of material) for cover and/or joined paper for using the cover and/or the joined paper.

Here, the predetermined number of sheets NSp is the number of sheets of recording media on which post-processing may be performed at one time by the post-processing unit 30. Moreover, the predetermined number of sheets NSp may be set to be the number of sheets that corresponds to operating conditions, specifications, etc., of the post-processing unit 30. Furthermore, the predetermined number of sheets NSp may be set to be the number of sheets that is predetermined by an experiment, a numerical computation, etc.

The I/F unit 70 is a unit which performs inputting and outputting of information (an electrical signal, for example) between the image forming apparatus 100 and the outside of the image forming apparatus 100. The I/F unit 70 according to the present embodiment makes it possible to input into and output from an external apparatus (a PC, etc.) information on the image forming apparatus 100 (for example, "information on a state" or "information on processing" of the image forming apparatus 100).

In the present embodiment, the I/F unit 70 includes the input section 71 into which certain information sets (for example, image forming conditions, operation conditions, output conditions, etc.) are input from outside the image forming apparatus 100 to the image forming apparatus 100 by a user (an apparatus operator, an apparatus administrator, etc., below called "a user"). Moreover, in the present embodiment, the I/F unit 70 includes the output section 72 from which information is output (for example, displayed) to the outside of the image forming apparatus 100.

Into the input section 71 may be input conditions on image forming (below called "image forming conditions"). In the present embodiment, into the input section 71 may be input information on content for carrying out post-processing (below called "processing determination information"), for example, information on whether a cover is arranged on the outside of the multiple recording media. Moreover, into the input section 71 may be input the processing determination information on whether the post-processing unit 30 executes post-processing, for example.

The output section 72 may output the image forming conditions. Moreover, the output section 72 may output information (below called "processing selection information") required for selecting content for carrying out post-processing. The output section 72 may output processing selection information on determination results determined by the determining unit 60 or calculation results calculated by the calculating unit 50, for example.

(Image Forming Operation)

Figure 2:
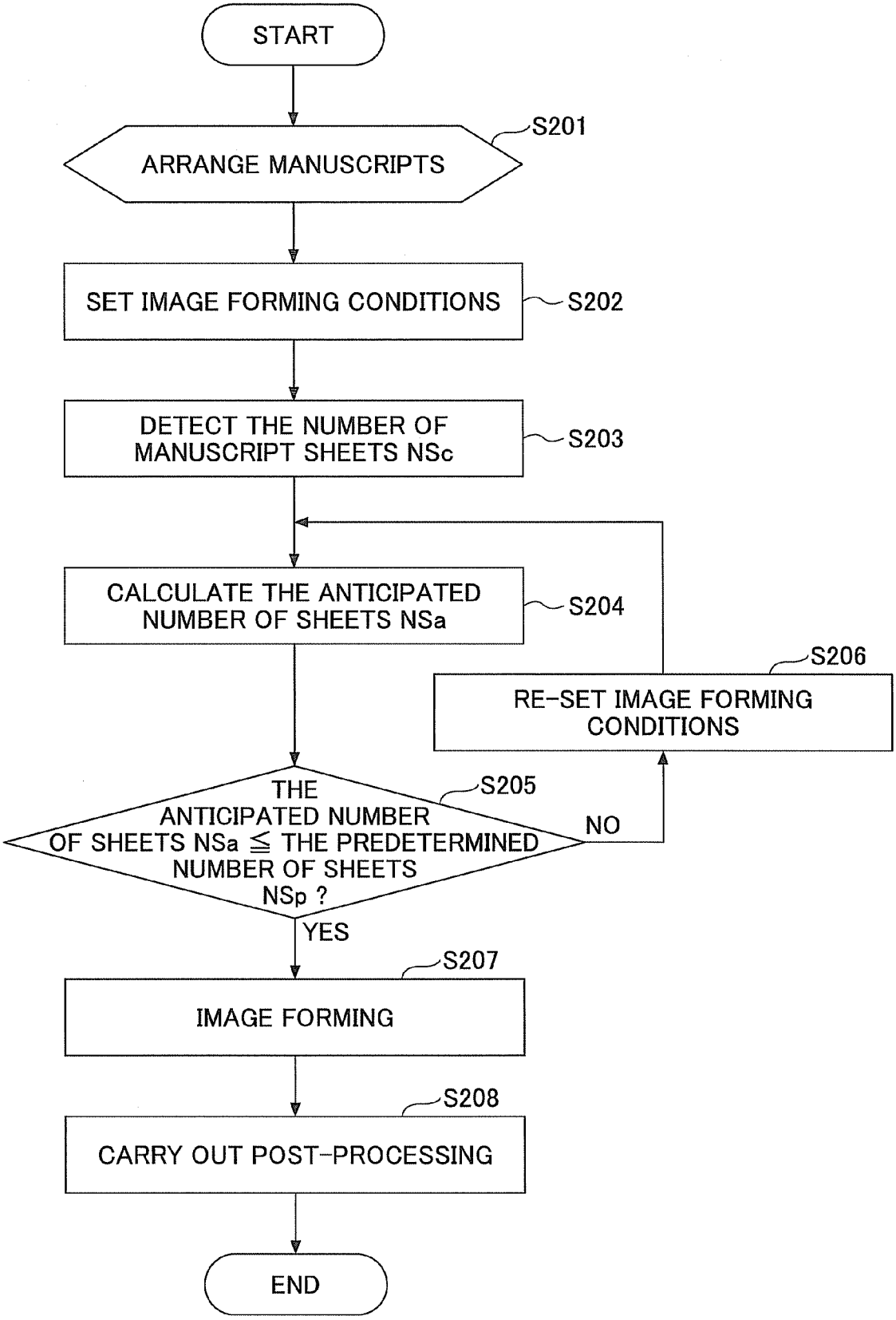
FIG. 2 is a flowchart for explaining one example of an operation of the image forming apparatus according to an embodiment of the present invention.

FIG. 2 shows an image forming operation of the image forming apparatus 100 according to an embodiment of the present invention.

As shown in FIG. 2, at first, at the image forming apparatus 100 (FIG. 1), manuscripts are arranged by a user, etc., in step S201. Then, the image forming apparatus 100 proceeds to step S202.

Next, information on image forming conditions are input into the image forming apparatus 100 using the I/F unit 70 (FIG. 1). More specifically, the information on the image forming conditions is input into the image forming apparatus 100 using the input section 71 (for example, below-described FIG. 10 or FIG. 11) by the user, etc. Moreover, the image forming apparatus 100 stores the input information into the control unit 10 (the storage section). Then, the image forming apparatus 100 proceeds to step S203.

Here, the information on the image forming conditions may include information on modes for image forming on the recording media (double-sided printing, single-sided printing, aggregate (reduce and enlarge) and other printing modes) and on content of post-processing (stapling, bookbinding, sorting, etc.). Moreover, the information on the image forming conditions may further include information on chapter division and chapter break (below called "inserting") by cover, joined paper, and other divider paper sheets. Furthermore, the information on the image forming conditions may include information on the number of manuscript sheets NSc.

The image forming apparatus 100 may carry out an operation of step S202 before step S201.

Next, in step S203, the image forming apparatus 100 detects the number of manuscript sheets NSc using the detecting unit 40 (FIG. 1) (detecting step). Then, the image forming apparatus 100 proceeds to step S204. When information on the number of manuscript sheets NSc is input into the image forming apparatus 100 in step S202, the image forming apparatus 100 may detect (calculate) the number of manuscript sheets NSc using the input information on the number of manuscript sheets NSc.

In step S204, the image forming apparatus 100 calculates the anticipated number of sheets NSa using the calculating unit 50 (FIG. 1). Then, the image forming apparatus 100 proceeds to step S205. The calculating unit 50 may calculate the anticipated number of sheets NSa using information input by the input section 71 (FIG. 1). Furthermore, the calculating unit 50 may calculate the anticipated number of sheets NSa based on modes for image forming on the recording media (for example, double-sided (double-sided printing), single-sided (single-sided printing), aggregate (reduce/enlarge), and other printing modes).

When image forming, on both sides of the recording media, storage content formed onto only one side of a manuscript, for example, the anticipated number of sheets NSa, which is generally half the number of manuscript sheets NSc, may be calculated. Moreover, when image forming onto the recording medium by aggregating manuscript images, for example, the calculating unit 50 may calculate the anticipated number of sheets NSa, which is less than the number of manuscript sheets NSc.

In step S205, the image forming apparatus 100 uses the determining unit 60 (FIG. 1) to determine whether the anticipated number of sheets NSa exceeds the predetermined number of sheets NSp (determining step). In other words, the image forming apparatus 100 determines whether multiple image-formed recording media may be bound in a bundle. If the anticipated number of sheets NSa exceeds the predetermined number of sheets NSp, the image forming apparatus 100 proceeds to step S206. Otherwise, the image forming apparatus 100 proceeds to step S207. For the image forming conditions such that post-processing (for example, stapling) is not carried out (step S202), the image forming apparatus 100 may proceed to step S207 without performing the determining.

In step S206, the image forming apparatus 100 updates the information on the image forming conditions that was input in step S202. More specifically, the image forming apparatus 100 may update information on mode for image forming onto the recording media and on inserting. In other words, if the anticipated number of sheets NSa exceeds the predetermined number of sheets NSp, the image forming apparatus 100 updates information on image forming conditions in order to decrease the number of sheets for which multiple image-formed recording media may be bound in a bundle. Then, the image forming apparatus 100 proceeds to step S204.

Next, in step S207, the image forming apparatus 100 forms an image on the recording media using the image forming unit 20 (FIG. 1). Then, the image forming apparatus 100 proceeds to step S208.

In step S208, the image forming apparatus 100 uses the post-processing unit 30 (FIG. 1) to perform post-processing on multiple image-formed recording media (bookbinding step). Here, the post-processing unit 30 may perform post-processing based on input image forming conditions (step S202). Then, the image forming apparatus 100 proceeds to END in FIG. 2, completing the image forming operation.

(Programs for Image Forming Method, and Recording Medium Having Recorded Therein the Programs)

According to computer programs Pr for the image forming method of the present invention, an image forming method is executed, the image forming method including the steps of: detecting the number of manuscript sheets on which an image is formed; calculating the anticipated number of sheets of recording media on which the image is formed based on the detected number of sheets; determining whether the anticipated number of sheets calculated exceeds the predetermined number of sheets; and performing bookbinding in which multiple recording media on which the image is formed are bound, wherein, in the calculating step, the anticipated number of sheets is calculated, further including a cover arranged on the outside of the multiple recording media which are stacked in an overlapping manner, and wherein, in the bookbinding step, multiple recording media are bound without arranging the cover on the outside of the multiple recording media when the image is not formed on the cover if the determining unit determines that the anticipated number of sheets exceeds the predetermined number of sheets. This configuration makes it possible to obtain advantageous effects equivalent to those of the image forming apparatus 100 according to an embodiment of the present invention.

Moreover, the present invention may provide a computer readable recording medium Md having recorded thereon computer programs Pr. For the recording medium Md having recorded the computer programs Pr, a flexible disk, a CD-ROM, a memory card, and other computer-readable media may be used.

In light of the above, the image forming apparatus 100 according to an embodiment of the present invention makes it possible to bind recording media in one bundle by decreasing the number of recording media when the number of sheets of the recording media that is calculated based on the number of manuscript sheets exceeds the number of sheets which can be bound in one bundle. More specifically, the image forming apparatus 100 may determine whether post-processing may be performed on the recording media based on the detected number of manuscript sheets and the calculated anticipated number of sheets of the recording media. In other words, the image forming apparatus 100 according to the embodiment of the present invention makes it possible to bind the recording media in one bundle by decreasing the number of sheets of the recording media when the number of sheets of the recording media exceeds the number of sheets which may be bound in one bundle.

EXAMPLES

The present invention will be explained using examples of the image forming apparatus.

Example 1

The present invention will be explained using an image forming apparatus 110E according to Example 1 of the present invention.

(Configuration of Image Forming Apparatus)

FIG. 1 shows a schematic configuration diagram of the image forming apparatus 110E according to the present example.

As shown in FIG. 1, the configuration of the image forming apparatus 110E according to the present example is basically the same as a configuration of the image forming apparatus 100 according to the previously-described embodiment, so that different parts will mainly be described.

Figure 3:
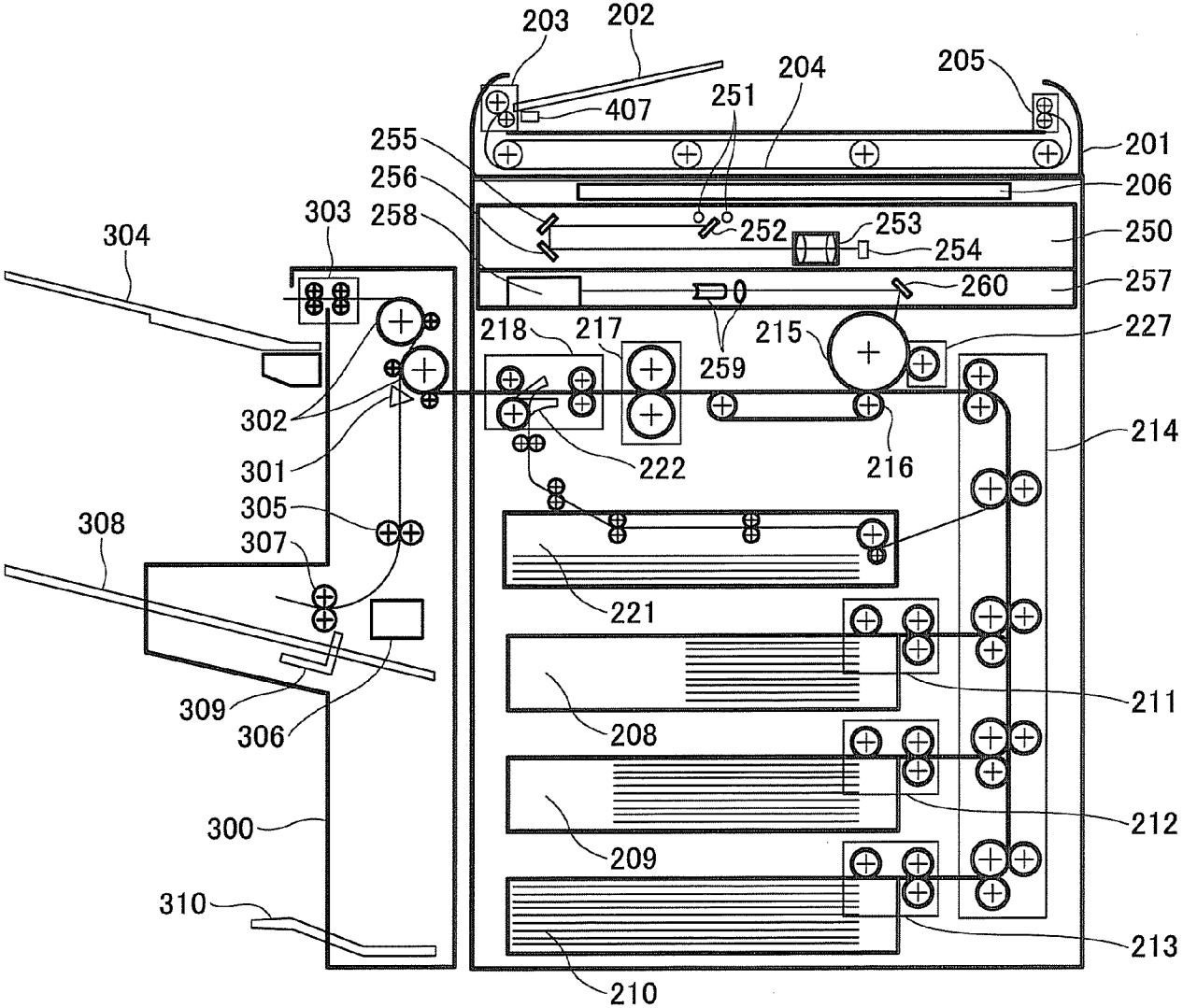
FIG. 3 is a schematic sectional view illustrating one example of the image forming apparatus according to Example 1 of the present invention.

FIG. 3 shows a schematic sectional view of the image forming apparatus 110E according to the present example.

As shown in FIG. 3, the image forming apparatus 110E according to the present example includes a write unit 257, a fixing unit 217, etc., as the image forming section 21 (FIG. 1).

Based on image data read in a read unit 250 (the manuscript conveying section 23), the write unit 257 uses laser to form a latent image onto a surface of a photoreceptor 215. Next, with the write unit 257, the latent image-formed photoreceptor 215 passes by the developing unit 227. At this time, the write unit 257 forms a toner image on a surface of the photoreceptor 215 in accordance with the latent image on the surface of the photoreceptor 215. Moreover, the write unit 257 transfers a toner image formed on the surface of the photoreceptor 215 to a recording medium conveyed by a conveying belt 216.

Here, a latent image (for example, an electrostatic latent image) is a potential distribution which occurs on a surface of the photoreceptor 215 by irradiating, onto the surface of the photoreceptor 215, a laser light which corresponds to content recorded on a manuscript (below called "a manuscript image").

The fixing unit 217 fixes (melts and fixes, secures) the toner image onto the recording medium. The fixing unit 217 heats, pressurizes, etc., the toner-image transferred recording medium to fix the toner image onto the recording medium.

The image forming apparatus 110E may drive the photoreceptor 215, the fixing unit 217, the developing unit 227, etc., using a main motor (not shown).

In the present embodiment, the image forming apparatus 110E includes a vertical conveying unit 214 and a paper discharging unit 218, etc., as the medium conveying section 22 (FIG. 1). The vertical conveying unit 214 according to the present embodiment includes a first tray 208, a second tray 209, a third tray 210, a first paper feeding apparatus 211, a second paper feeding apparatus 212, a third paper feeding apparatus 213, etc. Using the first paper feeding apparatus 211 and a conveying belt 216, the vertical conveying unit 214 conveys a recording medium contained in the first tray 208, etc., to a position which touches the photoreceptor 215.

The paper discharging unit 218 discharges (carries out) the toner-image fixed recording medium to a below-described post-processing apparatus 30 (finisher 300).

The image forming apparatus 110E may drive the conveying belt 216, the paper discharging unit 218, etc., using the main motor (not shown). Moreover, the image forming apparatus 110E may drive the paper feeding apparatuses 211-213 via a paper feeding clutch, etc., using the main motor. Furthermore, the image forming apparatus 110E may drive the vertical conveying unit 214 via an intermediate clutch, etc., using the main motor.

In the present example, the image forming apparatus 110E includes an automatic manuscript sending apparatus (below called "ADF") 201, etc., as the manuscript conveying section 23 (FIG. 1).

The ADF 201 feeds (conveys) a manuscript (a bundle of manuscripts) placed on a manuscript holder 202 with an image face of the manuscript facing upward, starting from the bottommost manuscript, to a predetermined position on a contact glass 206 using a feeding roller 203 and a feeding belt 204. Moreover, the ADF 201 reads, as image data, content recorded on the manuscript on the contact glass 206 using the read unit 250. Then, using the feeding belt 204 and a discharging roller 205, the ADF 201 discharges (conveys) the manuscript for which reading has been completed. Furthermore, if the below-described manuscript setting detecting section 407 (the detecting unit 40) detects that there is a subsequent manuscript on the manuscript holder 202, the ADF 201 feeds the subsequent manuscript onto the contact glass 206 in the same manner as the previous manuscript.

The ADF 201 may drive the feeding roller 203, the feeding belt 204, and the discharging roller 205 using the motor (not shown).

In the present example, the image forming apparatus 110E includes the finisher 300 as the post-processing unit 30 (FIG. 1).

Using a switching plate 301, a finisher 300 conveys the image-formed recording medium in a direction in which post-processing is not carried out (normally a direction of the discharging roller 302) or a direction in which the post-processing is carried out (a direction of a stapler 306). More specifically, in the present example, the finisher 300 may switch the switching plate 301 to the upper side to convey the recording medium in the direction in which the post-processing is not carried out. Moreover, the finisher 300 may switch the switching plate 301 to the lower side to convey the recording medium in the direction in which the post-processing is carried out.

When the post-processing is not carried out, the finisher 300 discharges the recording medium to a paper discharging tray 304 via a conveying roller 303. Here, the paper discharging tray 304 can be moved (forward and backward, for example). The paper discharging tray 304 may be moved at the time of paper discharging to sort (easily sort) multiple image-formed recording media in correspondence with each recording medium (each copy) sorted by an image memory or each manuscript.

Moreover, when the post-processing is carried out, the finisher 300 conveys the recording medium to a stapling platform 308 via conveying rollers 305 and 307. Here, with respect to multiple recording media which are stacked on the stapling platform 308, edge faces of the recording media are jogged by a jogger for paper jogging 309 each time one sheet is discharged. Next, multiple recording media stacked are bound by the stapler 306. Then, the multiple recording media which are bound by the stapler 306 are stored in a stapled paper-discharging tray 310 (by self weight, for example).

On the other hand, when an image is formed on both sides of the recording medium, the image forming apparatus 110E according to the present example sets a branching claw 222 on the lower side and stores (stocks), in a double-sided paper feeding unit 221 once, the recording medium on which single-sided only images are formed. Next, the image forming apparatus 110E again conveys, to the write unit 257, the recording medium which is stocked in the double-sided paper feeding unit 221. Then, an image is formed on a surface of the recording medium on which an image is not formed. Thereafter, the image forming apparatus 110E sets the branching claw 222 on the upper side and conveys the recording medium to the paper discharging tray 304.

In this way, the image forming apparatus 110E may form an image on both sides of the recording medium.

According to the present example, the image forming apparatus 110E includes a manuscript setting detecting section 407 as the detecting unit 40 (FIG. 1). The manuscript setting detecting section 407 detects a manuscript on the manuscript holder 202.

(Operations of Read Unit and Write Unit)

Using FIG. 3, operations of the read unit 250 and the write unit 257 are explained.

As shown in FIG. 3, according to the present example, the read unit 250 includes an optical scanning system (an exposure lamp 251, etc.) and a contact glass 206 on which a manuscript is placed. According to the present example, the optical scanning system of the read unit 250 includes the exposure lamp 251, a first mirror 252, a second mirror 255, a third mirror 256, a lens 253, a CCD image sensor 254, etc. The optical scanning system is driven by a scanner driving motor (not shown).

The exposure lamp 251 and the first mirror 252 are fixed onto a first carriage (not shown). The second mirror 255 and the third mirror 256 are fixed onto the first carriage (not shown).

When a manuscript image is read, the read unit 250 (mechanically) scans the first carriage and the second carriage at a relative speed of 2:1 such that an optical path length does not change. Then, the read unit 250 reads the manuscript image using the CCD image sensor 254. More specifically, the read unit 250 detects light and shade, etc., of a light as a pixel output signal which corresponds to each pixel of the CCD image sensor 254 and outputs the pixel output signal as an electrical signal.

The read unit 250 may move the lens 253 and the CCD image sensor 254 to change magnification of a manuscript image detected (optical zooming). In other words, the read unit 250 may change a position of the lens 253 and the CCD image sensor 254 in correspondence with magnification designated by the image forming conditions, etc.

In the present example, the write unit 257 includes a laser output unit 258, an imaging lens 259, a mirror 260, etc. Moreover, the write unit 257 includes, inside the laser output unit 258, a polygonal rotating mirror (for example, a polygon mirror) which rotates at a constant high speed by a motor and a laser light source (for example, a laser diode).

The write unit 257 deflects, by the polygonal rotating mirror which rotates at constant speed, a laser light irradiated by the laser output unit 258, and transmits the deflected laser light through the imaging lens 259 to irradiate the transmitted light onto the mirror 260. Here, the transmitted light irradiated is reflected by the mirror 260 and collected and imaged onto the surface of the photoreceptor 215.

Here, the write unit 257 exposes and scans the laser light (a deflected light, a transmitted light, a reflected light) in a direction which is orthogonal to a direction in which the photoreceptor 215 rotates (below called "a main scanning direction"). In this way, the write unit 257 may form an electrostatic latent image on a surface of the photoreceptor 215 in correspondence with a line unit of an image signal output from a selector 164 (FIG. 4) of the below-described image processing section. Moreover, the write unit 257 forms an image (the electrostatic latent image) on the surface of the photoreceptor 215 by repeating main scanning at a predetermined period which corresponds to a recording density and a rotating speed of the photoreceptor 215.

The write unit 257 may arrange a beam sensor (not shown) which generates (produces) a main scanning synchronization signal at a position in the vicinity of one end of the photoreceptor 215, at which position the laser light is irradiated. In this way, based on the main scanning synchronization signal, the write unit 257 may produce a control signal for performing below-described inputting and outputting of an image signal and control of image forming start timing in the main scanning direction based on the main scanning synchronization signal.

(Operation of Control Unit)

Figure 4:
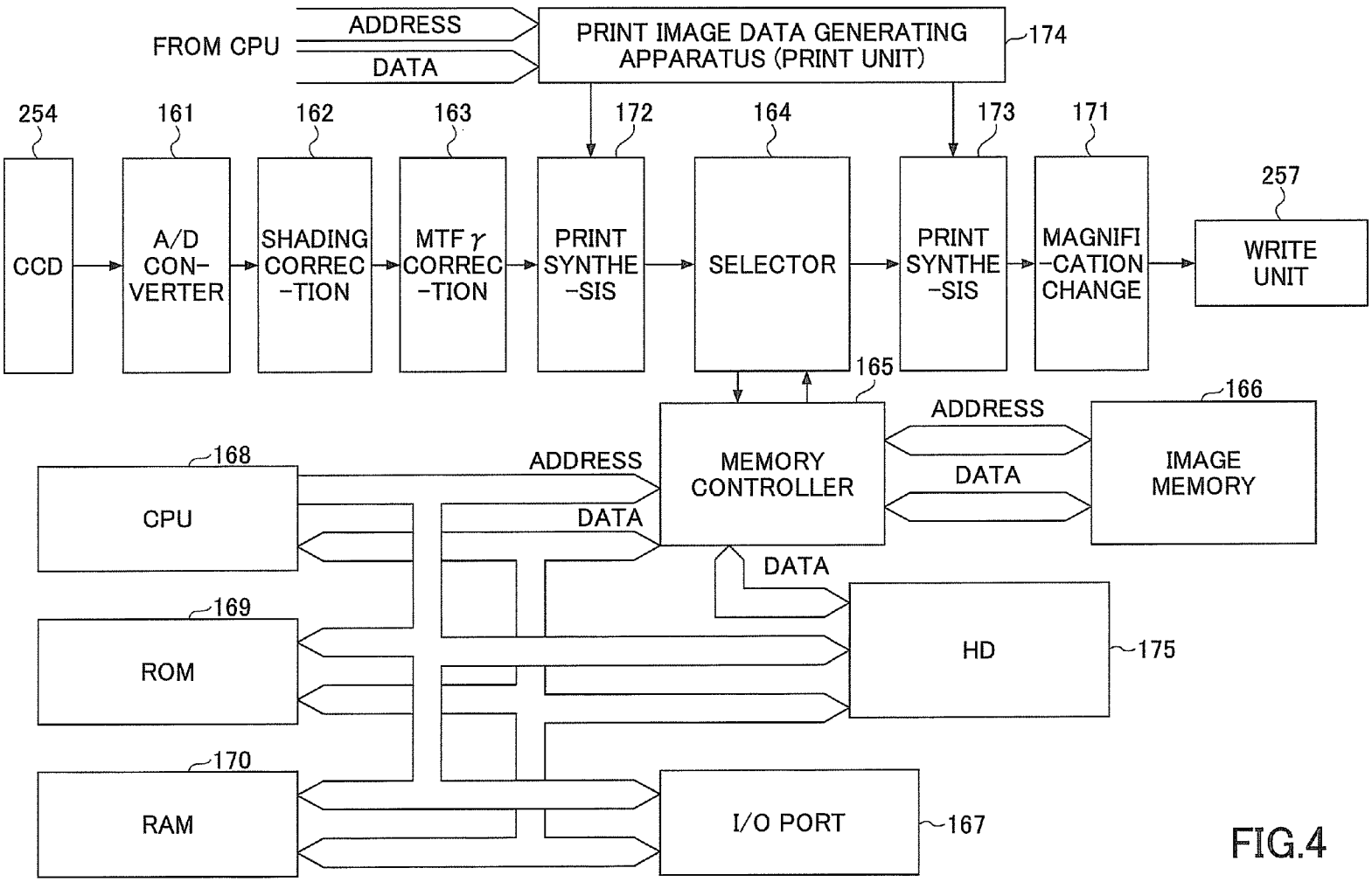
FIG. 4 is an explanatory diagram for explaining one example of a control unit of the image forming apparatus according to Example 1 of the present invention.
Figure 5:
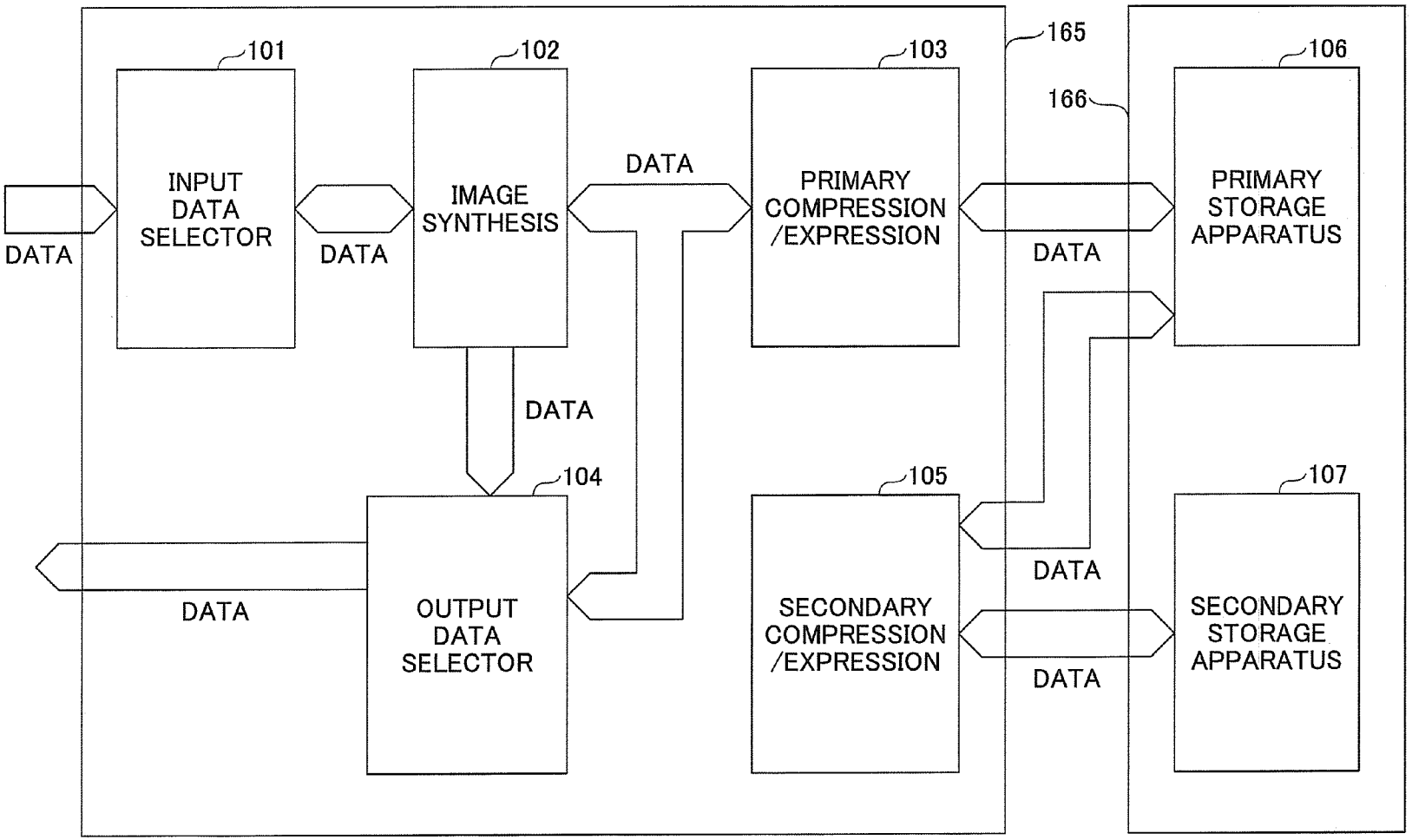
FIG. 5 is a functional block diagram for explaining one example of a function of the control unit of the image forming apparatus according to Example 1 of the present invention.
Figure 6:
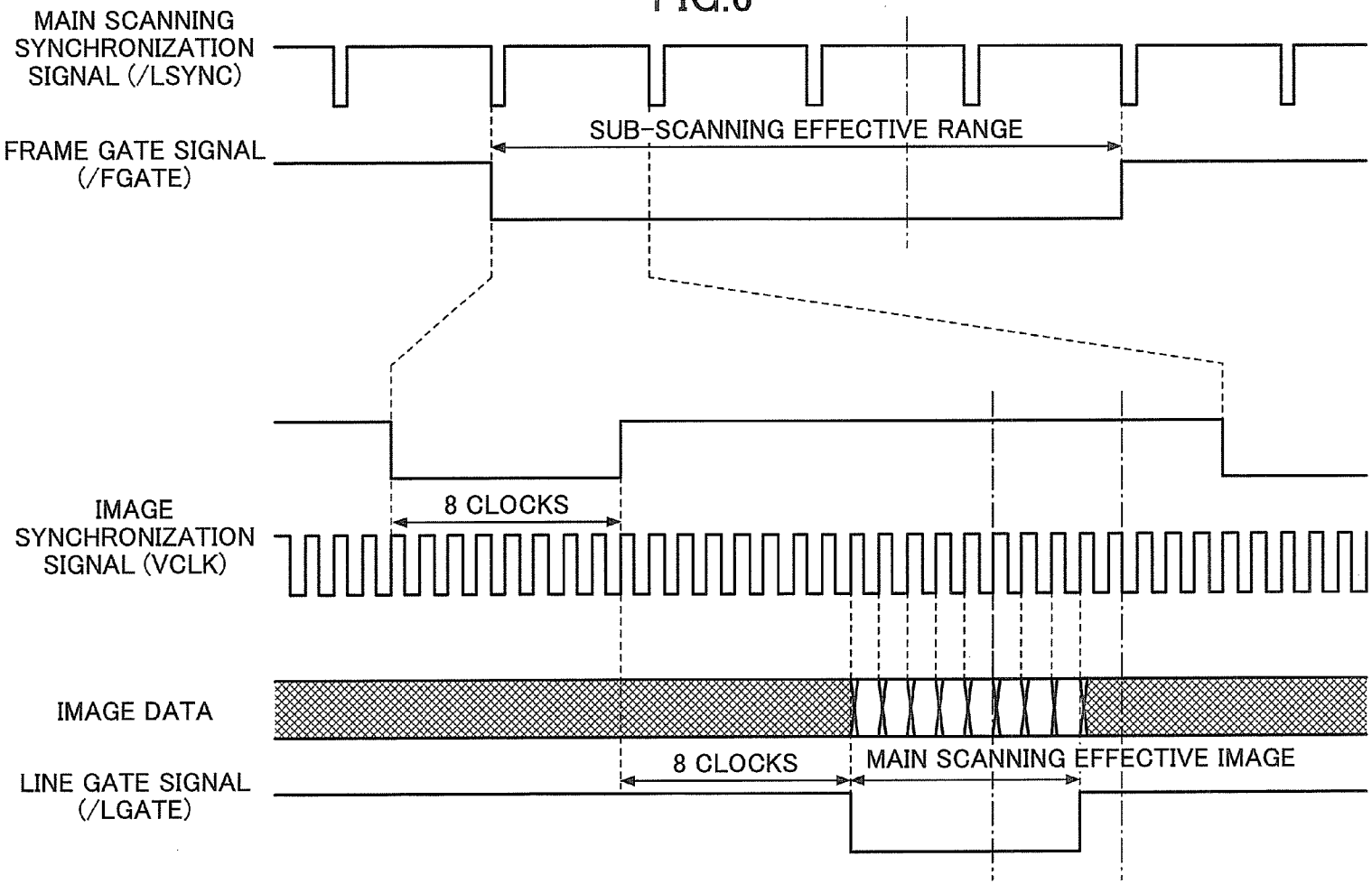
FIG. 6 is an explanatory diagram for explaining one example of processing an image signal of the image forming apparatus according to Example 1 of the present invention.

An operation of the control unit 10 of the image forming apparatus 110E according to the present Example is described using FIGS. 4 to 6.

As shown in FIG. 4, the control unit 10 of the image forming apparatus 110E according to the present embodiment converts, to a digital signal (an image signal), a pixel output signal which is photoelectric converted by the CCD image sensor 254 (FIG. 3) using an A/D converter 161 of an embedded image processing unit (IPU). Here, the converted digital signal undergoes shading correction (162), after which it undergoes MTF γ correction (163), etc., in an image processing section.

A selector 164 of the control unit 10 switches a destination of the image signal to a magnification changing section 171 or an image memory controller 165. Here, an image signal which passed through the magnification changing section 171 is image processed (enlarged/reduced) in accordance with a magnification change ratio and output to the write unit 257 (FIG. 3). A memory controller 165 and the selector 164 of the control unit 10 can input and output the image signal in both directions.

Moreover, in the present example, the control unit 10 includes a CPU 168 which performs setting of the memory controller 165, etc., and control of the read unit 250 and the write unit 257. Furthermore, in the present example, the control unit 10 includes a ROM 169, a RAM 170, etc., which store data and programs for control. The CPU 168 may perform writing to and reading from a mass storage apparatus (below called "HD") 175 and writing to and reading from an image memory 166 data via an image memory controller 165.

The control unit 10 uses an image compression apparatus of the memory controller 165 to compress an image signal (image data) and output the compressed result to the image memory 166. Moreover, in order to store the image signal, the control unit 10 transfers the image signal to an HD 175 via the image memory 166. Here, the HD 175 stores the image signal (the image data).

Moreover, the control unit 10 may connect, to the CPU 168, a print unit 174 which is an apparatus which generates print image data. In this way, the control unit 10 may generate (control) an arbitrary image for stamp, a character image for page print and data print, etc. In other words, the control unit 10 may output, to the print synthesizing apparatuses 172 and 173, picture image data generated by the print unit 174 and synthesize an arbitrary image with a picture image (image data) output from the image memory or a manuscript image.

When print picture image from the print unit 174 is synthesized by the print synthesizing apparatus 172, the control unit 10 may print synthesize to a read picture (a scanned picture). Moreover, when print image data are synthesized by the print synthesizing apparatus 173, the control unit 10 may print synthesize to a picture image (picture data) output from the picture memory 166 (FIG. 5). Furthermore, the print unit 174 may use a print position control function to control a position at which print of generated picture image data is performed.

As shown in FIG. 5, the control unit 10 of the image forming apparatus 110E according to the present example compresses the image signal (the image data) to effectively utilize a storage area of the image memory 166. Moreover, the control unit 10 may compress the image signal (the image data) to store many manuscript image sets (image data sets) at one time. Furthermore, the control unit 10 may output, in a page order, the manuscript image (image data) stored as a sort function. Here, when outputting the manuscript image, the control unit 10 may output the image data of the image memory 166 while successively expanding it by an expanding apparatus within the memory controller 165 (electronic sorting).

Moreover, the control unit 10 may write an image signal (image data) into the image memory 166 from the HD 175, and then output the written results. Furthermore, the control unit 10 may utilize a function of the image memory 166 to successively write multiple manuscript images into areas into which is divided an area corresponding to one sheet of a recording medium of the image memory 166. For example, the control unit 10 may successively write 4 sheets of manuscript images to areas which are equally divided into 4, the areas corresponding to one sheet of the recording medium of the image memory 166. In this way, the control unit 10 may obtain image data in which 4 manuscript sheets are synthesized (aggregated) into one sheet of recording medium image (aggregate copying, aggregate mode).

Using FIG. 5, operations of the image memory 166 and the memory controller 165 of the control unit 10 of the present embodiment are specifically explained using FIG. 5. Here, data shown indicates image data. An address and data which are connected to (input into/output from) the CPU 168 are not illustrated.

The memory controller 165 includes an input data selector 101; an image synthesis section 102, a primary compression/expansion section 103, an output data selector 104; and a secondary compression/expansion section 105. The input data selector 101, etc., are controlled by the CPU 168 (FIG. 4).

In the present example, the image memory 166 includes a primary storage apparatus 106 and a secondary storage apparatus 107.

The primary storage apparatus 106 generally synchronizes to a transfer speed of the input image data to perform data writes into a storage section (a memory) or data reads from the storage section (the memory) at a time of image outputting. The primary storage apparatus 106 may use a memory such as a DRAM, etc., for example, in which a high speed access is possible. Moreover, the primary storage apparatus 106 includes an element (a section which interfaces with a memory controller) that can simultaneously execute input and output of data of an image which is divided into multiple areas based on a size (a volume) of image data processed.

Here, the control unit 10 connects two sets of address data lines (not shown) for reads and writes to an interface with the image memory controller 165 for making it possible to respectively execute, in parallel, inputting into and outputting from divided areas image data. This makes it possible for the control unit 10 to, while inputting (reading) an image into one area, output (write) an image from a different area.

The secondary storage apparatus 107 stores therein data in order to perform synthesis and sorting of an input image. For the secondary storage apparatus 107, a large-capacity memory (such as a hard disk, etc.) may be used.

Control may be simplified by using a high-speed accessible element for the first storage apparatus 106 and the second storage apparatus 107. Moreover, the secondary storage apparatus 107 may use a large-capacity recording medium in an inexpensive manner and perform an input and output data process via the first storage apparatus. This makes it possible for the storage unit 10 to perform operations such as inputting and outputting, saving, processing, etc., of a large amount of image data. Moreover, the above-described configuration results in the image forming apparatus 110E having an inexpensive and relatively simple configuration. Next, an operation of the control unit 10 (the memory controller 165) is explained.

(1) Image Input (Write to the Image Memory 166)

At a time of image input, the control unit 10 first uses the input data selector 101 to select image data to be written into the image memory 166 (the primary storage apparatus 106) from multiple data sets. Moreover, the control unit 10 outputs the selected image data to the image synthesis section 102 and synthesizes the output results with data which are already saved in the image memory 166.

Next, the control unit 10 uses the primary compression/expansion section 103 to compress image data which has undergone processing (synthesis processing) in the image synthesis section 102. Thereafter, the control unit 10 writes the compressed image data into the primary storage apparatus 106.

Next, the control unit 10 may further compress the data written into the primary storage apparatus 106 using the second compression/expansion section 105. Thereafter, the control unit 10 may store the further compressed image data in the secondary storage apparatus 107.

(2) Image Output (Read from the Image Memory 166)

At the time of image output, the control unit 10 first reads image data stored in the primary storage apparatus 106 at the time of image output. Then, the control unit 10 expands the image data of the primary storage apparatus 106 using the primary compression/expansion section 103 when the image data (image) to be output is stored in the primary storage apparatus 106. Moreover, the control unit 10 selects, by the output data selector 104, synthesized image data of input data and expanded data or the expanded data. Thereafter, the control unit 10 outputs (writes) selected data (image data or synthesized image data).

Next, the control unit 10 uses the image synthesis section 102 to synthesize input data and data of the primary storage apparatus 106 (synthesizing which includes a function of phase adjusting of image data). Thereafter, the control unit 10 performs a process of selecting of an output destination of the synthesized data (image outputting, writing back into the primary storage apparatus 106, and simultaneous outputting to both output destinations are also possible).

On the other hand, when image (image data) to be output is not stored in the primary storage apparatus 106, the control unit 10 expands, by the secondary compression/expansion section 105, image data to be output that are stored in the secondary storage apparatus 107. Moreover, the control unit 10 writes expanded data into the primary storage apparatus 106 and carries out the same operation as the above-described image output operation.

Using FIG. 6, an operation is explained of the control unit 10 of an image forming apparatus 110E according to the present embodiment using the selector 164 (FIG. 4) to process an image signal corresponding to one page.

Here, /FGATE shown is a signal indicating an effective period in a sub-scanning direction of image data corresponding to one page. /LSYNC is a signal indicating a main scanning synchronization signal for each line. In other words, the image signal becomes effective with a predetermined clock after /LSYNC signal has risen. /LGATE is a signal indicating that an image signal in the main scanning direction is effective. These signals are synchronized with a pixel clock VCLK. Moreover, these signals represent data of one pixel for one period of VCLK.

As shown in FIG. 6, in the present example, the control unit 10 (an image processing section (IPU)) includes a producing (generating) mechanism of /FGATE, /LSYNC, /LGATE, and VCLK, respectively, for image input and output. In other words, the control unit 10 (the image processing section (IPU)) may carry out a combination of various image inputs and outputs.

(Image Forming Operation)

Figure 7:
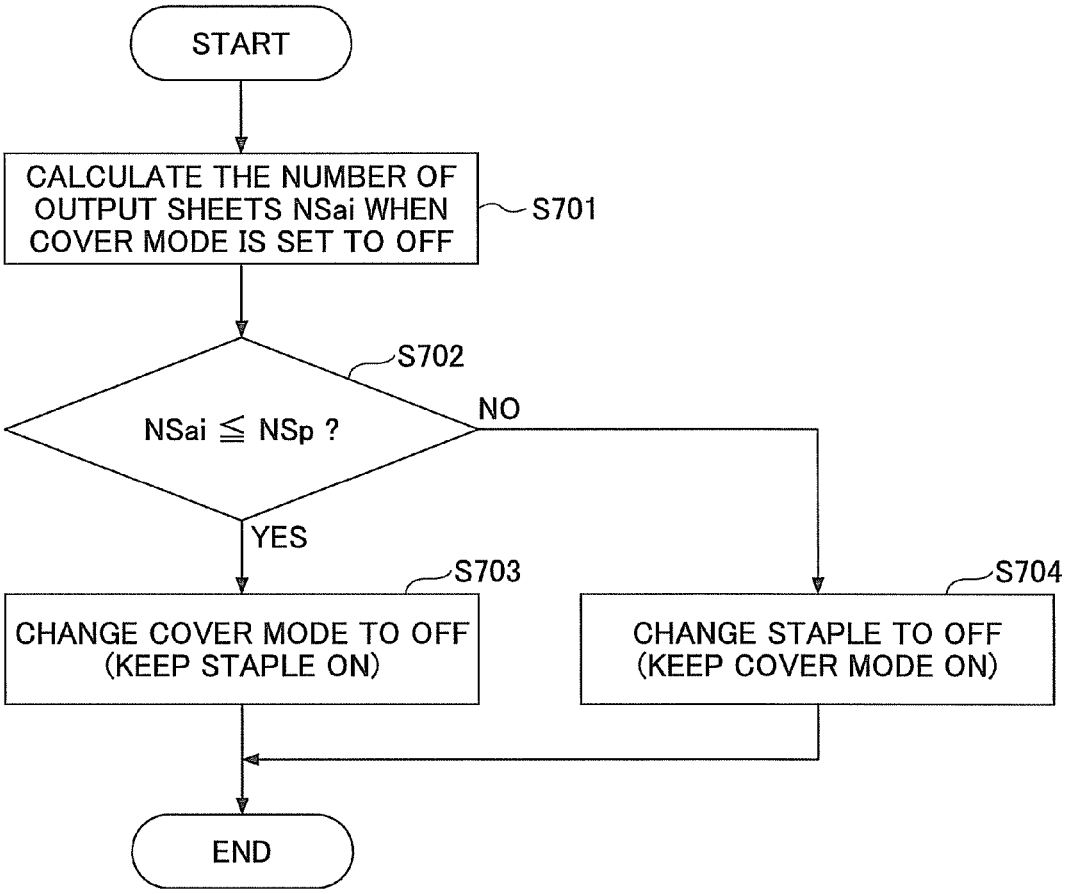
FIG. 7 is a flowchart for explaining one example of an operation of the image forming apparatus according to Example 1 of the present invention.

Using FIGS. 2, 7, and 8, an operation of the image forming apparatus 110E according to the present example forming an image is explained.

As shown in FIG. 2, in the same manner as the image forming apparatus 100 according to the embodiment, the image forming apparatus 110E according to the present embodiment first carries out steps S201-S205. Thereafter, if the anticipated number of sheets NSa exceeds the predetermined number of sheets NSp, the image forming apparatus 110E proceeds to step S206. Otherwise, the image forming apparatus 110E proceeds to step S207.

In step S206, the image forming apparatus 110E updates the information on the image forming conditions that was input in step S202. In the present example, the image forming apparatus 110E updates information on image forming conditions related to an inserter function. Specific explanations will be given below using FIGS. 7 and 8.

Figure 8A:
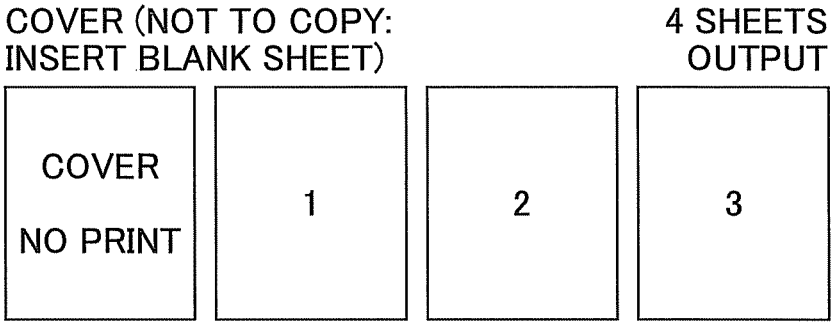
FIGS. 8A and 8B are explanatory diagrams for explaining one example of an operation of a bookbinding unit of the image forming apparatus according to Example 1 of the present invention.

In step S701 in FIG. 7, using the calculating unit 50 (FIG. 1), the image forming apparatus 110E calculates the anticipated number of sheets NSa when the inserter function is not carried out. The calculating unit 50 calculates the anticipated number of sheets NSai (3 sheets) of the medium when a cover is not added (FIG. 8B) in a case in which a cover is added to post-process 4 sheets of media as shown in FIG. 8A, for example. Thereafter, the image forming apparatus 110E proceeds to step S702.

Figure 8B:
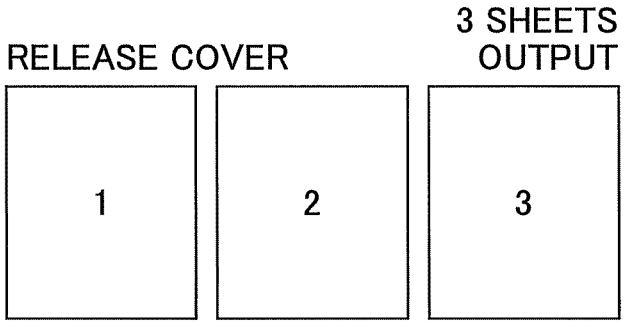

In step S702, the image forming apparatus 110E uses the determining unit 60 (FIG. 1) to determine whether the anticipated number of sheets NSai exceeds the predetermined number of sheets NSp. In other words, the image forming apparatus 110E determines whether the multiple image formed recording media may be bound in a bundle when the inserter function is not carried out (FIG. 8B, for example). If the anticipated number of sheets NSai does not exceed the predetermined number of sheets NSp, the image forming apparatus 110E proceeds to step S703. Otherwise, the image forming apparatus 110E proceeds to step S704.

In step S703, the image forming apparatus 110E updates the information on the image forming conditions (that was set in step S202). Here, the image forming apparatus 110E updates the information to image forming conditions such that the inserter function is not carried out. Thereafter, the image forming apparatus 110E returns to step S204 in FIG. 2.

On the other hand, in step S704, the image forming apparatus 110E updates the information on the image forming conditions. Here, the image forming apparatus 110E updates the information to image forming conditions such that the post-processing (for example, a stapling) function is not carried out. Thereafter, the image forming apparatus 110E returns to step S204 in FIG. 2.

Next, in steps S207 and S208 in FIG. 2, the image forming apparatus 110E carries out an operation similar to that of the image forming apparatus 100 in the embodiment. Thereafter, the image forming apparatus 110E proceeds to END shown, completing the image forming operation.

As described above, the image forming apparatus 110E according to Example 1 of the present invention may reduce the number of sheets of the recording media without adding a cover when recording media cannot be bound in one bundle in a case in which a cover is added to perform post-processing, making it possible to bind the recording media in one bundle. In other words, the image forming apparatus 110E according to the present example may determine whether an inserter function is released using the number of sheets of the recording media that is calculated using the number of manuscript sheets, making it possible to bind the recording media in one bundle by reducing the number of sheets of the recording media.

Moreover, the image forming apparatus 110E according to Example 1 of the present invention makes it possible to obtain the same advantageous effects as the image forming apparatus 100 according to the embodiment.

(Variation 1 of Example 1)

The present invention will be explained using an image forming apparatus 120E according to Variation 1 of Example 1 of the present invention.

(Configuration of Image Forming Apparatus; Operation of Read and Write Units; and Operation of Control Unit)

A schematic configuration diagram, etc., of the image forming apparatus 120E according to the present variation is shown in FIG. 1, etc.

As shown in FIG. 1, etc., a configuration, etc., of the image forming apparatus 120E according to the present variation is basically the same as a configuration, etc., of the image forming apparatus 110E according to the above-described Example 1, so that explanations will be omitted.

(Image Forming Operation)

Using FIG. 2, and FIGS. 9 to 11, an operation of the image forming apparatus 120E according to the present Variation forming an image is explained.

As shown in FIG. 2, in the same manner as the image forming apparatus 110E according to Example 1, the image forming apparatus 120E according to the present variation first carries out steps S201-S205. Thereafter, if the anticipated number of sheets NSa exceeds the predetermined number of sheets NSp, the image forming apparatus 120E proceeds to step S206. Otherwise, the image forming apparatus 120E proceeds to step S207.

In step S206, the image forming apparatus 120E updates the information on the image forming conditions that was input in step S202. In the present variation, the image forming apparatus 120E uses the output section 72 to output information (processing selection information) on processing of the image forming apparatus 120E. Moreover, in the image forming apparatus 120E, information (processing determination information) on processing of the image forming apparatus 120E is input using the input section 71. Specific explanations will be given below using FIGS. 9 to 11.

Figure 9:
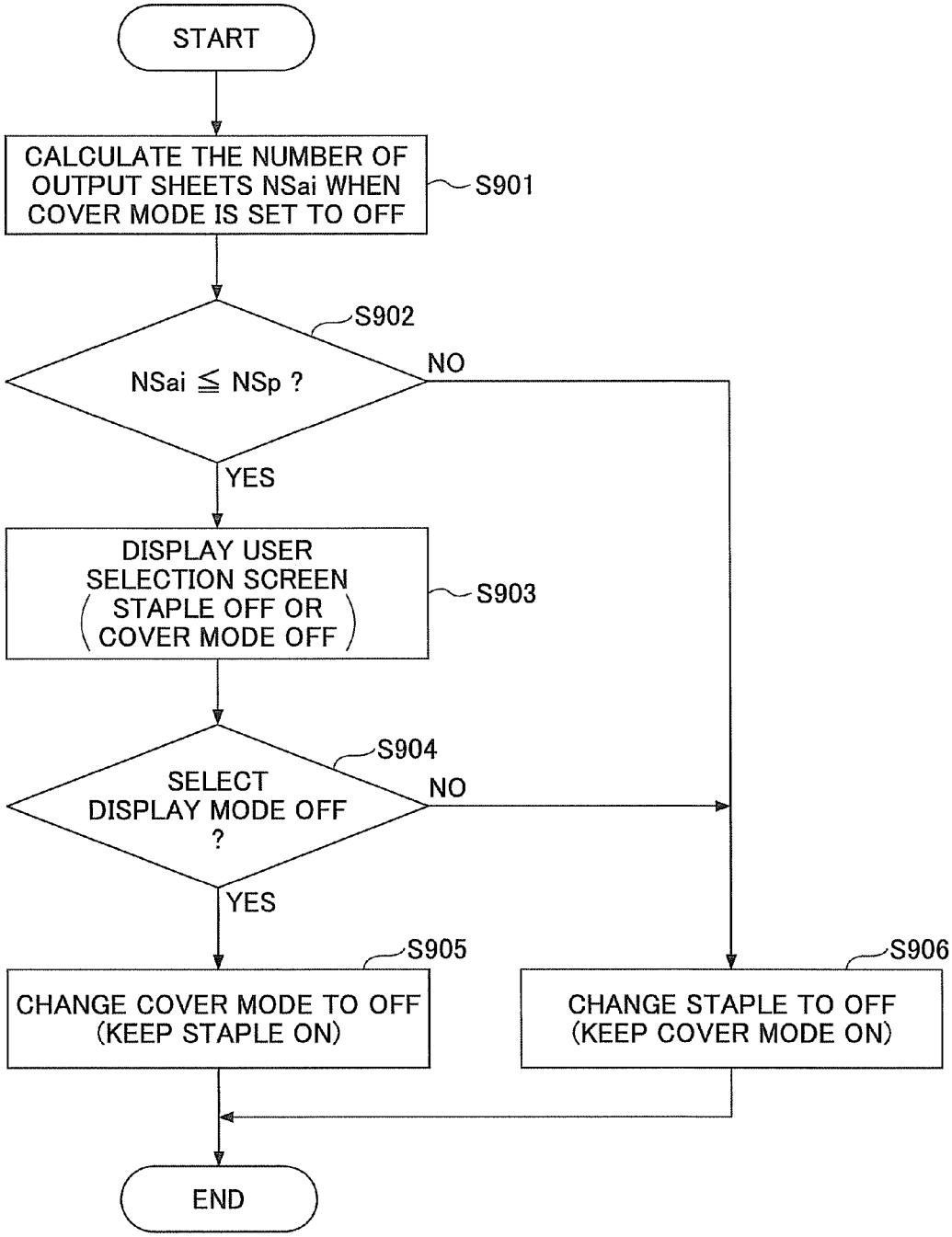
FIG. 9 is a flowchart for explaining one example of an operation of the image forming apparatus according to Variation 1 of Example 1 of the present invention.

In a step S901 in FIG. 9, using the calculating unit 50 (FIG. 1), the image forming apparatus 120E calculates the anticipated number of sheets NSa when the inserter function is not carried out, as in Example 1. The calculating unit 50 calculates the anticipated number of sheets NSai (3 sheets) of the medium when a cover is not added (FIG. 8B) in a case in which a cover is added to post-process 4 sheets of media as shown in FIG. 8A, for example. Thereafter, the image forming apparatus 120E proceeds to step S902.

In step S902, the image forming apparatus 110E uses the determining unit 60 (FIG. 1) to determine whether the anticipated number of sheets NSai exceeds the predetermined number of sheets NSp as in Example 1. In other words, the image forming apparatus 120E determines whether the multiple image formed recording media may be bound in a bundle when the inserter function is not carried out (FIG. 8B, for example). If the anticipated number of sheets NSai does not exceed the predetermined number of sheets NSp, the image forming apparatus 120E proceeds to step S903. Otherwise, the image forming apparatus 120E proceeds to step S906.

In step S903, the image forming apparatus 120E uses the output section 72 to output process selection information. The output section 72 may output the process selection information to an operating unit of the image forming apparatus 120E shown in FIG. 10, for example. Thereafter, the image forming apparatus 120E proceeds to step S904.

Figure 10:
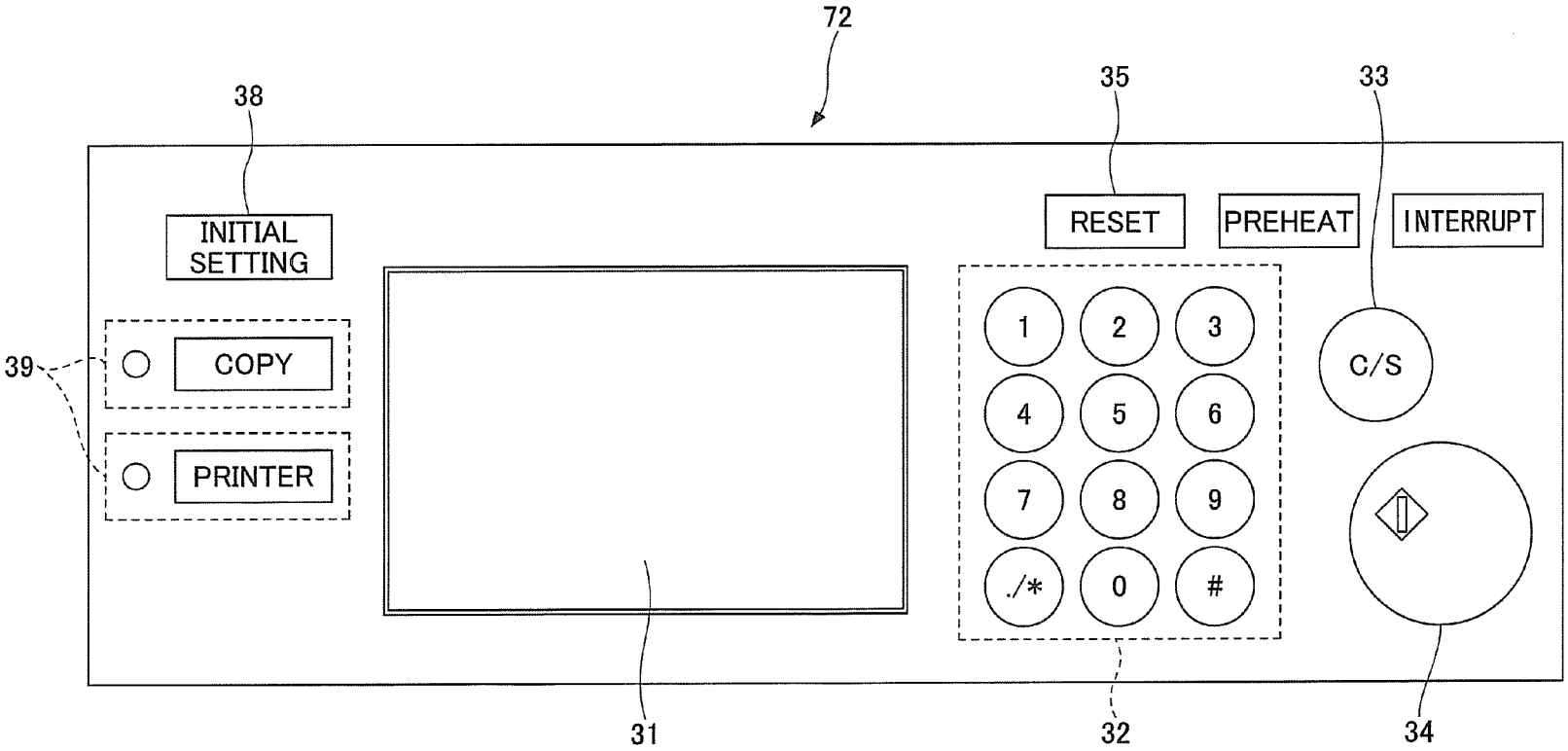
FIG. 10 is an explanatory diagram for explaining one example of an output section of the image forming apparatus according to Variation 1 of Example 1 of the present invention.

As examples of an operation unit of the image forming apparatus 120E are shown, in FIG. 10, a liquid crystal touch panel 731, a numerical pad 732, a clear/stop key 733, a print key 734, a mode clear key 735, etc. Here, the liquid crystal touch panel 731 may display a message which indicates a state of the image forming apparatus, the number of sheets, a function key, etc.

In step S904, in the image forming apparatus 120E, the input section 72 is used by the user to input process setting information. To the input section 72 may be input process determination information using an operating section (a touch panel, etc.) of the image forming apparatus 120E shown in FIG. 10, for example. Moreover, to the input section 72 may be input process determination information using an operating section (a touch panel, etc.) of the image forming apparatus 120E shown in FIG. 11, for example.

Thereafter, when the inserter function is not carried out (for example, when a cover is not added), the image forming apparatus 120E proceeds to step S905. When a post-process is stopped (when a stapling process is stopped, for example), the image forming apparatus 120E proceeds to step S906.

Figure 11:
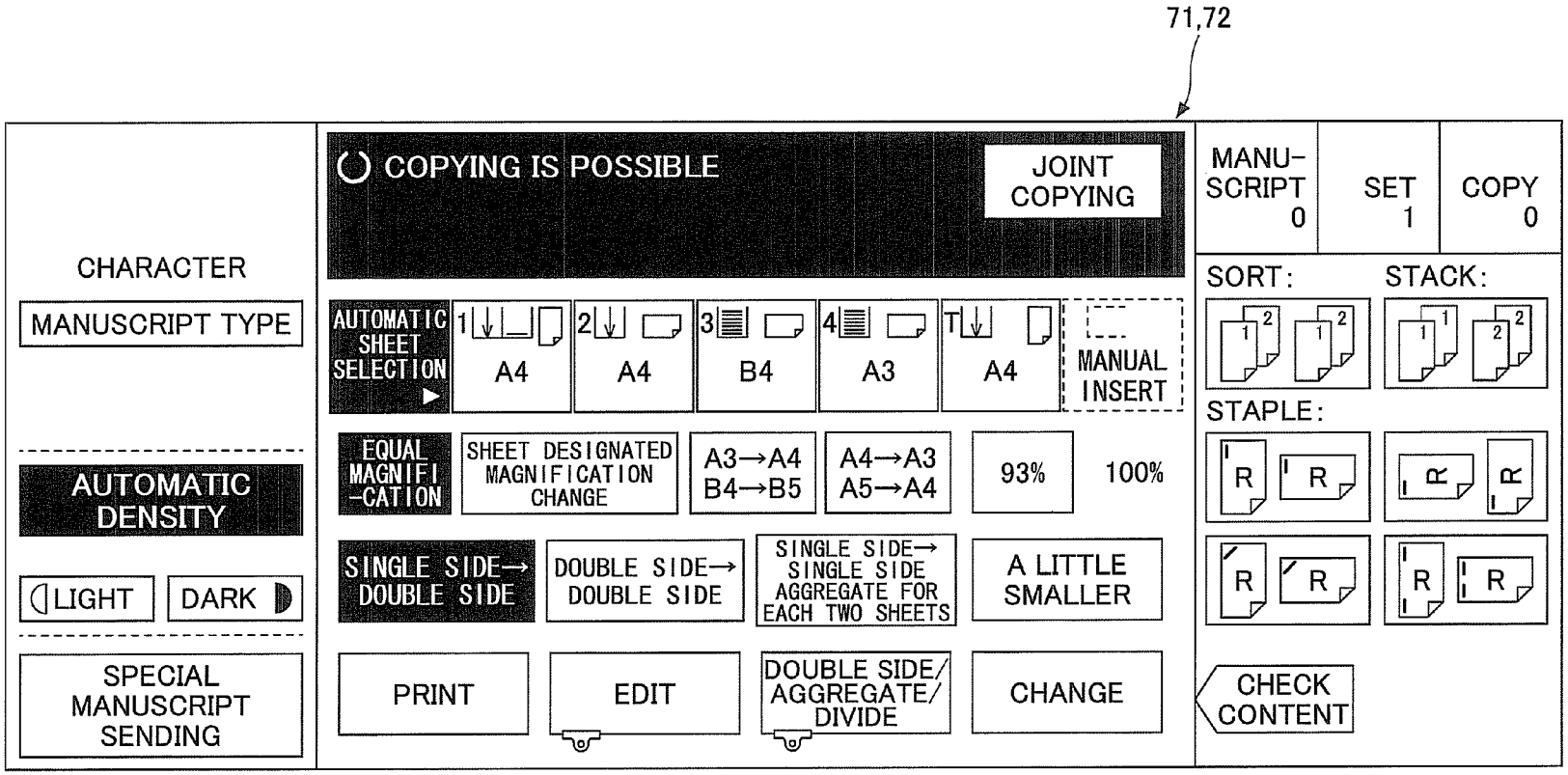
FIG. 11 is an explanatory diagram for explaining one example of an input section of the image forming apparatus according to Variation 1 of Example 1 of the present invention.

FIG. 11 shows one example of displaying of a liquid crystal touch panel 31 (FIG. 10) of an operating unit of the image forming apparatus 120E in FIG. 11. As shown in FIG. 11, the liquid crystal touch panel 731 may display a message area; the number of copy sheets display section which displays the number of sheets set; an automatic density key which automatically adjusts image density; an automatic sheet selection key which automatically selects recording media; a processing key (a sort key) which jogs each one copy sheet in a page order; a stapling key which designates a process of binding sorted sheets for each sheet; an equal magnification key which sets magnification to equal magnification; a magnification change key which sets enlargement/reduction magnification; a double side key which sets a double side mode; an erase/move key which sets a binding margin mode, etc.; a print key which sets print of a stamp, a date, a page, etc. Here, as shown, a key selected is displayed in a screened manner.

The user may touch a key displayed on the liquid crystal touch panel 731 to input (select) information on image forming conditions. Here, a key selected, etc., may be inverted to black. Moreover, when details of a function (for example, a magnification change value, etc., of magnification change) is input (selected), a key may be touched to display a setting screen of a different detail function.

Next, in step S905, the image forming apparatus 120E updates the information on the image forming conditions (that was set in step S202). Here, based on information input, the image forming apparatus 120E updates the information to the image forming conditions in which the inserter function is not carried out. Thereafter, the image forming apparatus 120E returns to step S204 in FIG. 2.

On the other hand, in step S906, the image forming apparatus 120E updates information on the image forming conditions. Here, based on information input, the image forming apparatus 120E updates the information to the image forming conditions in which post-processing is stopped. Thereafter, the image forming apparatus 120E returns to step S204 in FIG. 2.

Next, in steps S207 and S208 in FIG. 2, the image forming apparatus 120E carries out an operation similar to that of the image forming apparatus 110E in Example 1. Thereafter, the image forming apparatus 120E proceeds to END shown, completing the image forming operation.

As described above, the image forming apparatus 120E according to Variation 1 of Example 1 of the present invention makes it possible to bind recording media in one bundle based on image forming conditions set in re-setting by the user when the recording media cannot be bound in one bundle in a case in which a cover is added to perform post-processing. In other words, in the image forming apparatus 120E according to the present variation, whether an inserter function may be released may be selected by a user, making it possible to increase convenience for the user.

Moreover, the image forming apparatus 120E according to Variation 1 of Example 1 of the present invention makes it possible to obtain the same advantageous effects as the image forming apparatus 110E according to Example 1.

(Variation 2 of Example 1)

The present invention will be explained using an image forming apparatus 130E according to Variation 2 of Example 1 of the present invention.

(Configuration of Image Forming Apparatus; Operation of Read and Write Units; and Operation of Control Unit)

A schematic configuration diagram, etc., of the image forming apparatus 130E according to the present variation is shown in FIG. 1, etc.

As shown in FIG. 1, etc., a configuration, etc., of the image forming apparatus 130E according to the present Variation is basically the same as a configuration, etc., of the image forming apparatus 110E according to the above-described Example 1, so that explanations will be omitted.

(Image Forming Operation)

Using FIG. 2, and FIGS. 12 to 14, an operation of the image forming apparatus 130E according to the present variation forming an image is explained.

As shown in FIG. 2, in the same manner as the image forming apparatus 110E according to Example 1, the image forming apparatus 130E according to the present variation first carries out steps S201-S205. Thereafter, if the anticipated number of sheets NSa exceeds the predetermined number of sheets NSp, the image forming apparatus 130E proceeds to step S206. Otherwise, the image forming apparatus 130E proceeds to step S207.

In step S206, in the present variation, the image forming apparatus 130E updates the information on the image forming conditions that was input in step S202. Specific explanations will be given below using FIGS. 12 to 14.

In step S1201 in FIG. 12, the image forming apparatus 130E first determines whether an image is formed on respectively arranged covers (front and back covers) in a case (below called "both cover mode") in which a cover is arranged on both the one outer side and the other outer side of multiple recording media for an inserter function based on the image forming conditions input in step S202. For a case of the both cover mode and in which an image is not formed on the covers, the image forming apparatus 130E proceeds to step S1202. Otherwise, the image forming apparatus 130E proceeds to step S1205.

Figure 13A:
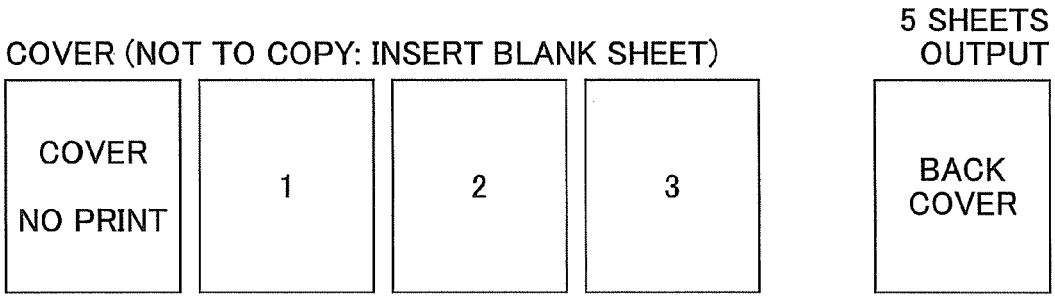
FIGS. 13A and 13B are explanatory diagrams for explaining one example of the operation of the bookbinding unit of the image forming apparatus according to Variation 2 of Example 1 of the present invention.

In step S1202, using the calculating unit 50 (FIG. 1), the image forming apparatus 130E calculates the anticipated number of sheets NSa when an inserter function for the back cover is not carried out, as in Example 1. The calculating unit 50 calculates the anticipated number of sheets NSai (4 sheets) of the medium when a back cover is not added (FIG. 13B) in a case in which covers (front and back covers) are added to post-process 5 sheets of media as shown in FIG. 13A, for example. Thereafter, the image forming apparatus 130E proceeds to step S1203.

Figure 13B:
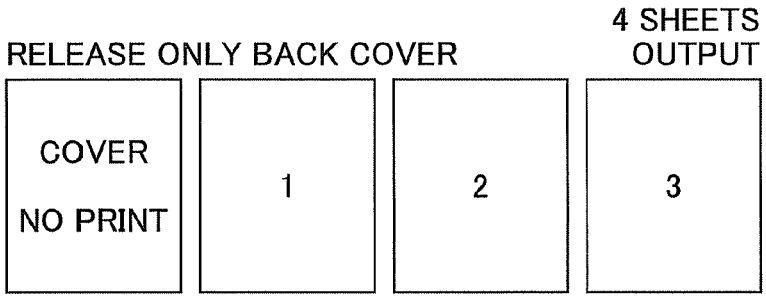

In step S1203, the image forming apparatus 130E uses the determining unit 60 (FIG. 1) to determine whether the anticipated number of sheets NSai exceeds the predetermined number of sheets NSp. In other words, the image forming apparatus 130E determines whether the multiple image formed recording media may be bound in a bundle when an inserter function for the back cover is not carried out (FIG. 13B, for example). If the anticipated number of sheets NSai does not exceed the predetermined number of sheets NSp, the image forming apparatus 130E proceeds to step S1204. Otherwise, the image forming apparatus 130E proceeds to step S1205.

In step S1204, the image forming apparatus 130E updates the information on the image forming conditions (that was set in step S202). Here, the image forming apparatus 130E updates the information to image forming conditions such that the inserter function for the back cover is not carried out. Thereafter, the image forming apparatus 130E returns to step S204 in FIG. 2.

On the other hand, in step S1205, the image forming apparatus 130E updates the information on the image forming conditions. Here, the image forming apparatus 130E updates the information to image forming conditions such that the post-processing (for example, stapling) is not carried out. Thereafter, the image forming apparatus 130E returns to step S204 in FIG. 2.

Next, in steps S207 and S208 in FIG. 2, the image forming apparatus 130E carries out an operation similar to that of the image forming apparatus 110E in Example 1. Thereafter, the image forming apparatus 130E proceeds to END shown, completing the image forming operation.

Figure 14:
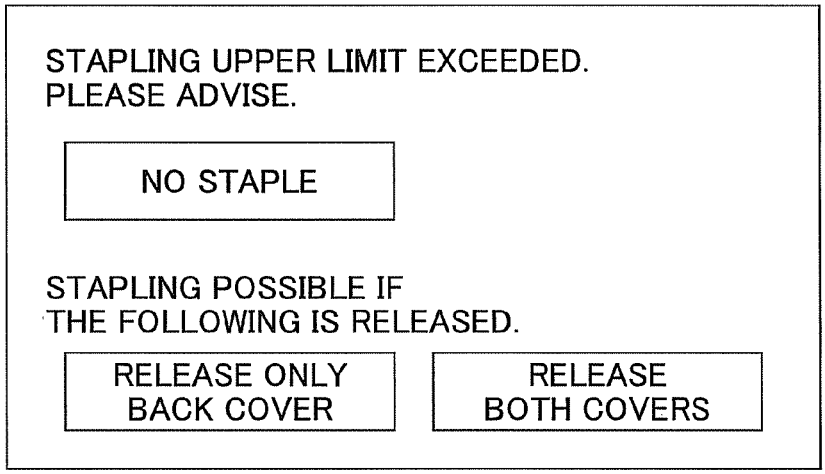
FIG. 14 is an explanatory diagram for explaining one example of the output section and the input section of the image forming apparatus according to Variation 2 of Example 1 of the present invention.

In the image forming apparatus 130E, stopping of a post-process (for example, stopping of a stapling process) or not carrying out an inserter function (for example, not adding the back cover) may be input by the user. As shown in FIG. 14, for example, the image forming apparatus 130E may display buttons (keys) for "no staple", and "release only back cover" and "release both covers" in an operating section of the image forming apparatus 130E (FIG. 11, for example). In this way, in the image forming apparatus 130E, not carrying out the inserter function or stopping the post-processing may be selected by the user.

As described above, the image forming apparatus 130E according to Variation 2 of Embodiment 1 of the present invention makes it possible to bind the recording media in one bundle without adding a back cover when the recording media cannot be bound in one bundle in a case in which covers (front and back covers) are added to perform post-processing. In other words, the image forming apparatus 130E according to the present variation may determine whether an inserter function is released using the number of sheets of the recording media that is calculated using the number of manuscript sheets, making it possible to bind the recording media in one bundle by decreasing the number of sheets of the recording media.

Moreover, the image forming apparatus 130E according to Variation 2 of Example 1 of the present invention makes it possible to obtain the same advantageous effects as the image forming apparatus 110E according to Example 1.

Example 2

The present invention will be explained using an image forming apparatus 140E according to Example 2 of the present invention.

(Configuration of Image Forming Apparatus; Operation of Read and Write Units; and Operation of Control Unit)

A schematic configuration diagram, etc., of the image forming apparatus 140E according to the present example is shown in FIG. 1, etc.

As shown in FIG. 1, etc., a configuration, etc., of the image forming apparatus 140E according to the present Variation is basically the same as a configuration, etc., of the image forming apparatus 100 according to the above-described embodiment, so that explanations will be omitted.

(Image Forming Operation)

Figure 15:
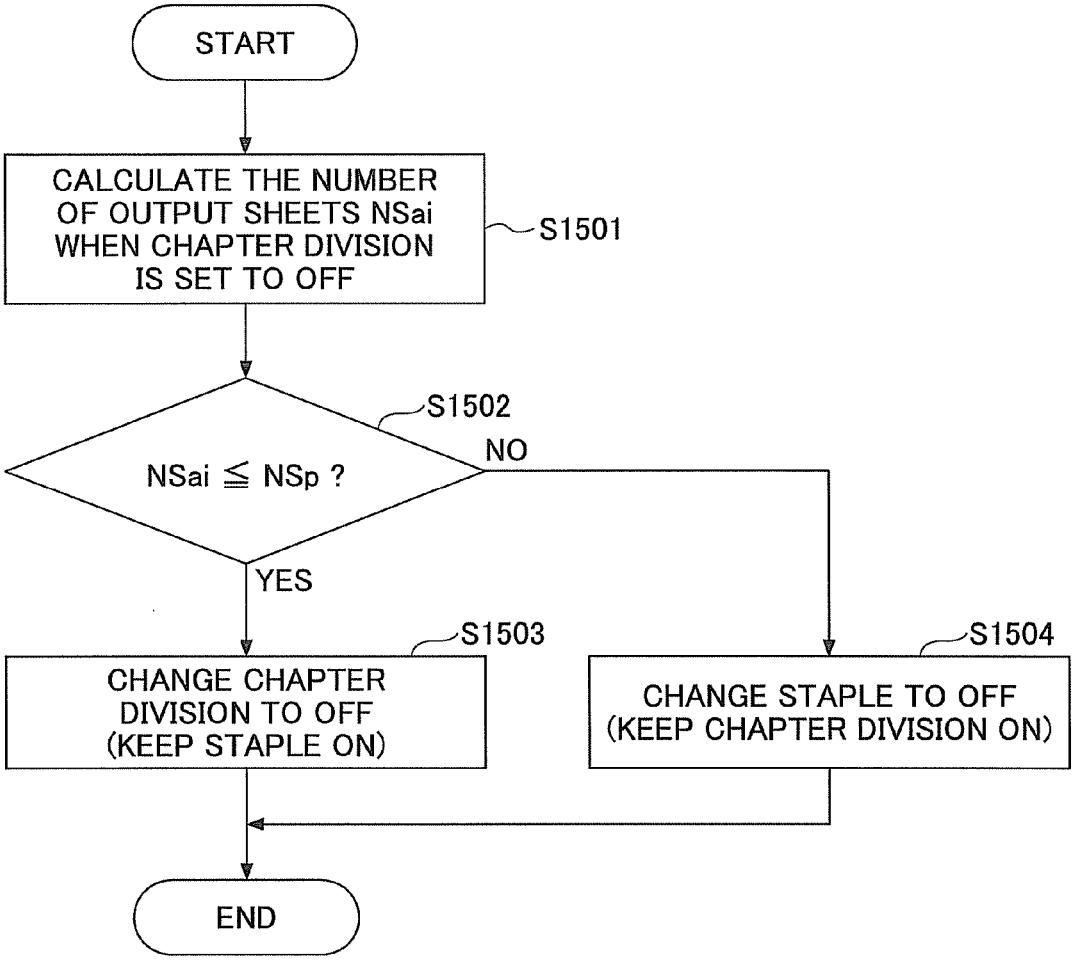
FIG. 15 is a flowchart for explaining one example of the operation of the image forming apparatus according to Example 2 of the present invention.

Using FIGS. 2, 15, and 16, an operation of the image forming apparatus 140E according to the present example forming an image is explained.

As shown in FIG. 2, in the same manner as the image forming apparatus 100 according to the embodiment, the image forming apparatus 140E according to the present example first carries out steps S201-S205. Thereafter, if the anticipated number of sheets NSa exceeds the predetermined number of sheets NSp, the image forming apparatus 140E proceeds to step S206. Otherwise, the image forming apparatus 140E proceeds to step S207.

In step S206, in the present example, the image forming apparatus 140E updates the information on the image forming conditions that was input in step S202. Specific explanations will be given below using FIGS. 15 and 16.

Figure 16A:
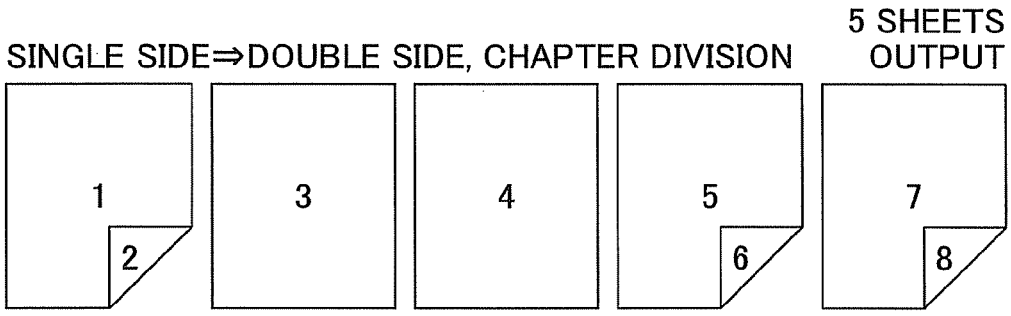
FIGS. 16A and 16B are explanatory diagrams for explaining one example of the operation of the bookbinding unit of the image forming apparatus according to Example 2 of the present invention.
Figure 16B:
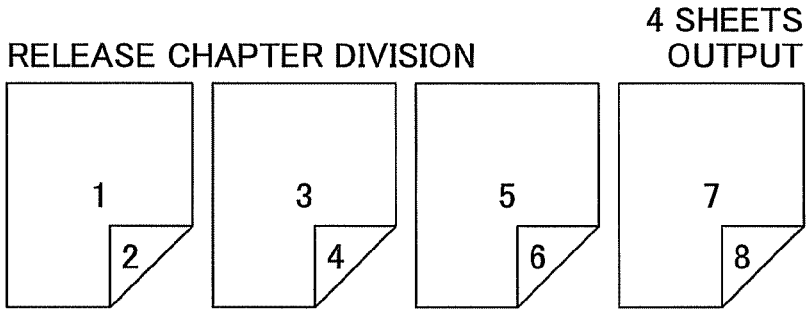

In step S1501 in FIG. 15, first, using the calculating unit 50 (FIG. 1), the image forming apparatus 140E calculates the anticipated number of sheets NSa when chapter division is not carried out in post-processing. The calculating unit 50 calculates the anticipated number of sheets NSai (4 sheets) of the media when chapter division is released (FIG. 16B) in a case in which chapter division is performed such that a starting page (image formed) of a chapter becomes a front face on the front cover side of the recording medium as shown in FIG. 16A, for example. Here, in FIG. 16A, the third, the fourth, the fifth, and the seventh pages are set to be the beginning of chapters. Thereafter, the image forming apparatus 140E proceeds to step S1502.

In step S1502, the image forming apparatus 140E uses the determining unit 60 (FIG. 1) to determine whether the anticipated number of sheets NSai exceeds the predetermined number of sheets NSp. In other words, the image forming apparatus 140E determines whether the multiple image formed recording media may be bound in a bundle when chapter division is not carried out (a case of FIG. 16B, for example). If the anticipated number of sheets NSai does not exceed the predetermined number of sheets NSp, the image forming apparatus 140E proceeds to step S1503. Otherwise, the image forming apparatus 140E proceeds to step S1504.

In step S1503, the image forming apparatus 140E updates the information on the image forming conditions (that was set in step S202). Here, the image forming apparatus 140E updates the information to image forming conditions such that the chapter division is not carried out. Thereafter, the image forming apparatus 140E returns to step S204 in FIG. 2.

On the other hand, in step S1504, the image forming apparatus 140E updates information on image forming conditions. Here, the image forming apparatus 140E updates the information to image forming conditions such that the post-processing (for example, a stapling) is not carried out. Thereafter, the image forming apparatus 140E returns to step S204 in FIG. 2.

Next, in steps S207 and S208 in FIG. 2, the image forming apparatus 140E carries out an operation similar to that of the image forming apparatus 100 in the Embodiment. Thereafter, the image forming apparatus 140E proceeds to END shown, completing the image forming operation.

As described above, the image forming apparatus 140E according to Example 2 of the present invention makes it possible to bind the recording media in one bundle without carrying out chapter division when the recording media cannot be bound in one bundle in a case in which chapter division is carried out to perform post-processing. In other words, the image forming apparatus 140E according to the present example may determine whether chapter division is carried out using the number of sheets of the recording media that is calculated using the number of manuscript sheets, making it possible to bind the recording media in one bundle by reducing the number of sheets of the recording media.

Moreover, the image forming apparatus 140E according to Example 2 of the present invention makes it possible to obtain the same advantageous effects as the image forming apparatus 100 according to the embodiment.

Example 3

The present invention will be explained using an image forming apparatus 150E according to Example 3 of the present invention.

(Configuration of Image Forming Apparatus; Operation of Read and Write Units; and Operation of Control Unit)

A schematic configuration diagram, etc., of the image forming apparatus 150E according to the present example is shown in FIG. 1, etc.

As shown in FIG. 1, etc., a configuration, etc., of the image forming apparatus 150E according to the present variation is basically the same as a configuration, etc., of the image forming apparatus 100 according to the above-described embodiment, so that explanations will be omitted.

(Image Forming Operation)

Using FIG. 2, and FIGS. 17 to 19, an operation of the image forming apparatus 150E according to the present example forming an image is explained.

As shown in FIG. 2, in the same manner as the image forming apparatus 100 according to the embodiment, the image forming apparatus 150E according to the present example first carries out steps S201-S205. Thereafter, if the anticipated number of sheets NSa exceeds the predetermined number of sheets NSp, the image forming apparatus 150E proceeds to step S206. Otherwise, the image forming apparatus 150E proceeds to step S207.

In step S206, in the present example, the image forming apparatus 150E updates the information on the image forming conditions that was input in step S202. Specific explanations will be given below using FIGS. 17, and 18A to 18D.

Figure 17:
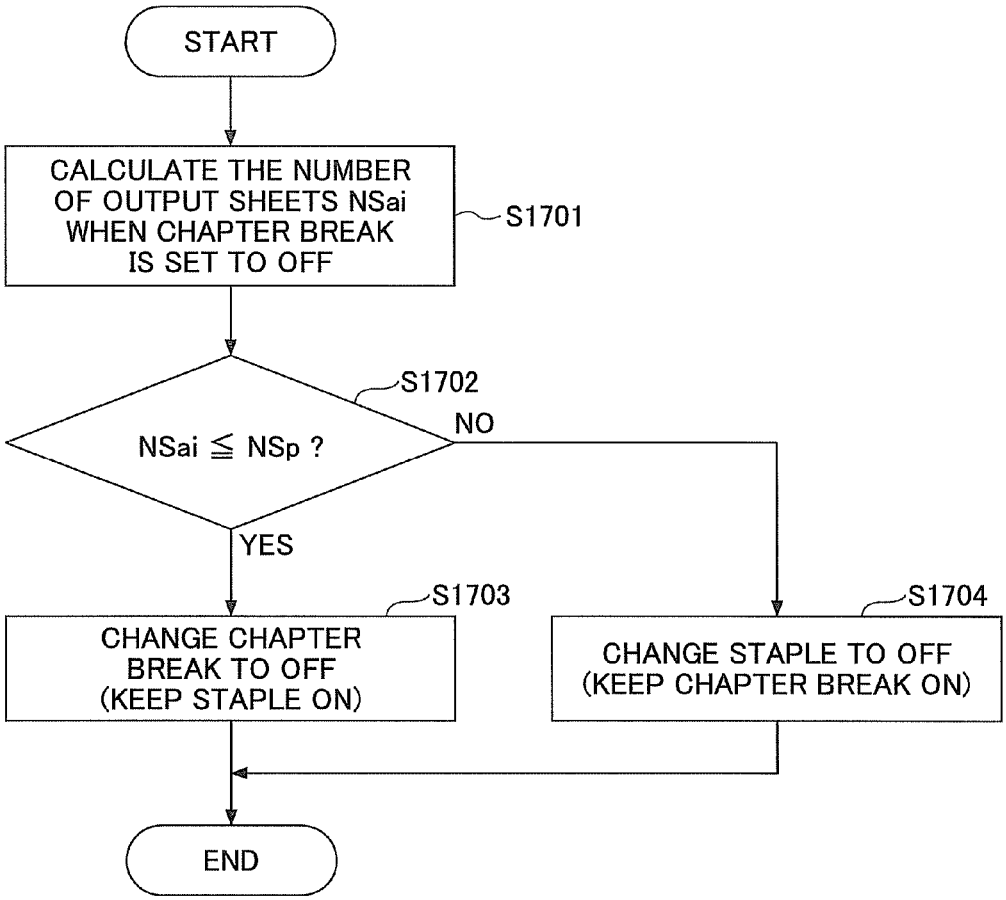
FIG. 17 is a flowchart for explaining one example of the operation of the image forming apparatus according to Example 3 of the present invention.
Figure 18A:
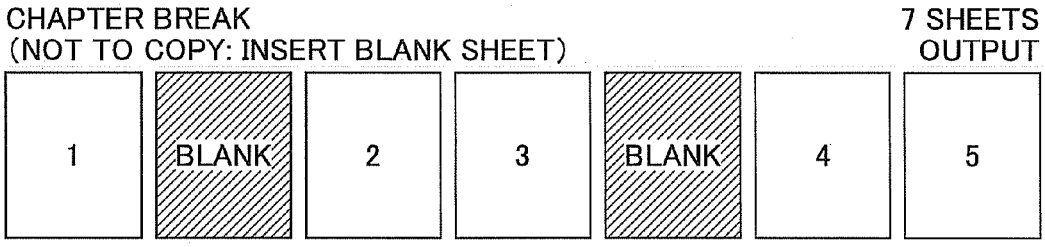
FIGS. 18A to 18D are explanatory diagrams for explaining one example of the operation of the bookbinding unit of the image forming apparatus according to Example 3 of the present invention.
Figure 18B:
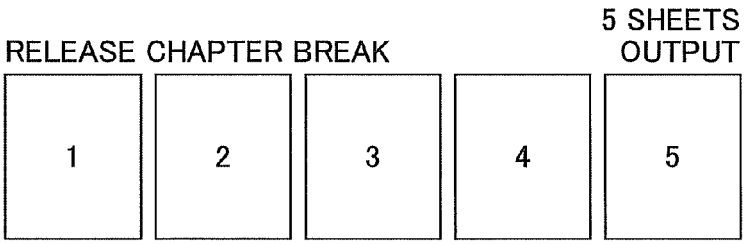

In a step S1701 in FIG. 17, first, using the calculating unit 50 (FIG. 1), the image forming apparatus 150E first calculates the anticipated number of sheets NSa when chapter break is not carried out in post-processing. The calculating unit 50 calculates the anticipated number of sheets NSai (5 sheets) of the media when chapter break is not performed (FIG. 18B) in a case in which joined paper sheets are added between chapters as shown in FIG. 18A, for example. Here, in FIG. 18A, a joined paper sheet for chapter break is added before the second page and before the fourth page. Thereafter, the image forming apparatus 150E proceeds to step S1702.

In step S1702, the image forming apparatus 150E uses the determining unit 60 (FIG. 1) to determine whether the anticipated number of sheets NSai exceeds the predetermined number of sheets NSp. In other words, the image forming apparatus 140E determines whether the multiple image formed recording media may be bound in a bundle when chapter break is not carried out (a case of FIG. 18B, for example). If the anticipated number of sheets NSai does not exceed the predetermined number of sheets NSp, the image forming apparatus 150E proceeds to step S1703. Otherwise, the image forming apparatus 150E proceeds to step S1704.

In step S1703, the image forming apparatus 150E updates the information on the image forming conditions (that was set in step S202). Here, the image forming apparatus 150E updates the information to image forming conditions such that the chapter break is not carried out. Thereafter, the image forming apparatus 150E returns to step S204 in FIG. 2.

On the other hand, in step S1704, the image forming apparatus 150E updates information on image forming conditions. Here, the image forming apparatus 150E updates the information to image forming conditions such that post-processing (for example, a stapling) is not carried out. Thereafter, the image forming apparatus 150E returns to step S204 in FIG. 2.

Next, in steps S207 and S208 in FIG. 2, the image forming apparatus 150E carries out an operation similar to that of the image forming apparatus 100 in the embodiment. Thereafter, the image forming apparatus 150E proceeds to END shown, completing the image forming operation.

Figure 18C:
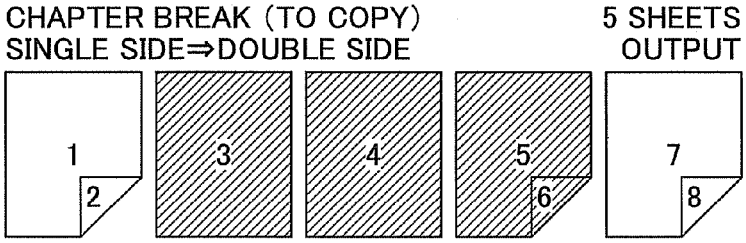
Figure 18D:
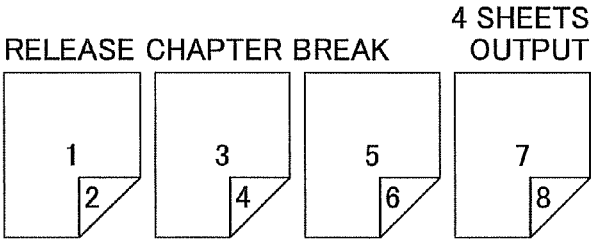

One example of performing double-sided printing on the recording medium in a case in which chapter break is carried out in post-processing is shown in FIGS. 18C and 18D. In this case, the image forming apparatus 150E calculates the anticipated number of sheets NSai (four sheets) of the media when chapter break is not performed (FIG. 18D) in a case in which chapter break is performed (five sheets) such that the beginning of a chapter is on the front face side of the recording medium as shown in FIG. 18C, for example. The subsequent operation is the same as described above, so that explanations will be omitted.

As described above, the image forming apparatus 150E according to Example 3 of the present invention makes it possible to bind the recording media in one bundle without carrying out chapter break when the recording media cannot be bound in one bundle in a case in which chapter break is carried out to perform post-processing. In other words, the image forming apparatus 150E according to the present example may determine whether chapter break is carried out using the number of sheets of the recording media that is calculated using the number of manuscript sheets, making it possible to bind the recording media in one bundle by reducing the number of sheets of the recording media.

Moreover, the image forming apparatus 150E according to Example 3 of the present invention makes it possible to obtain the same advantageous effects as the image forming apparatus 100 according to the embodiment.

The image forming apparatus 150E according to Example 3 of the present invention may include operations of Examples 1 and 2 in step S206.

Figure 12:
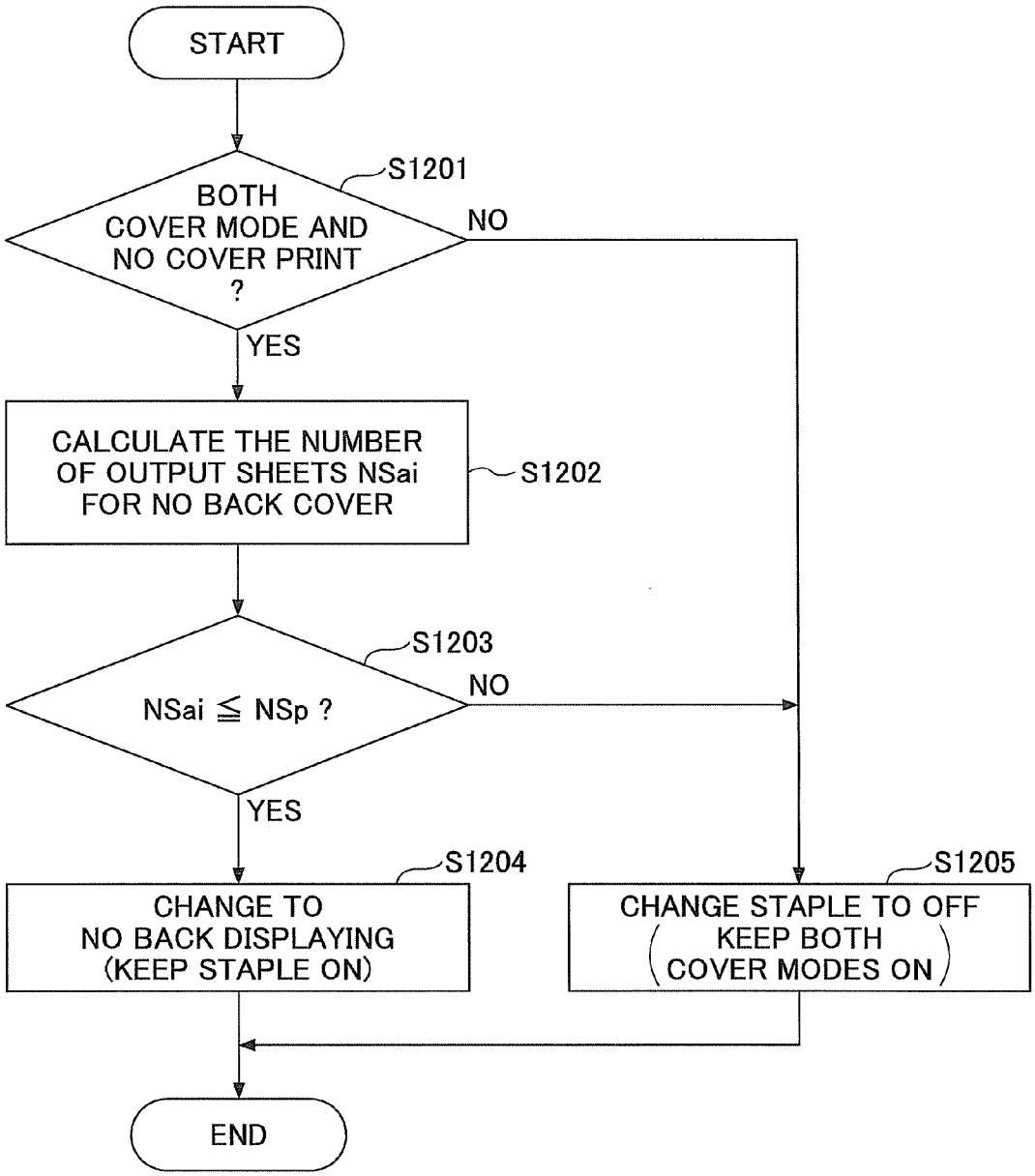
FIG. 12 is a flowchart for explaining one example of the operation of the image forming apparatus according to Variation 2 of Example 1 of the present invention.
Figure 19:
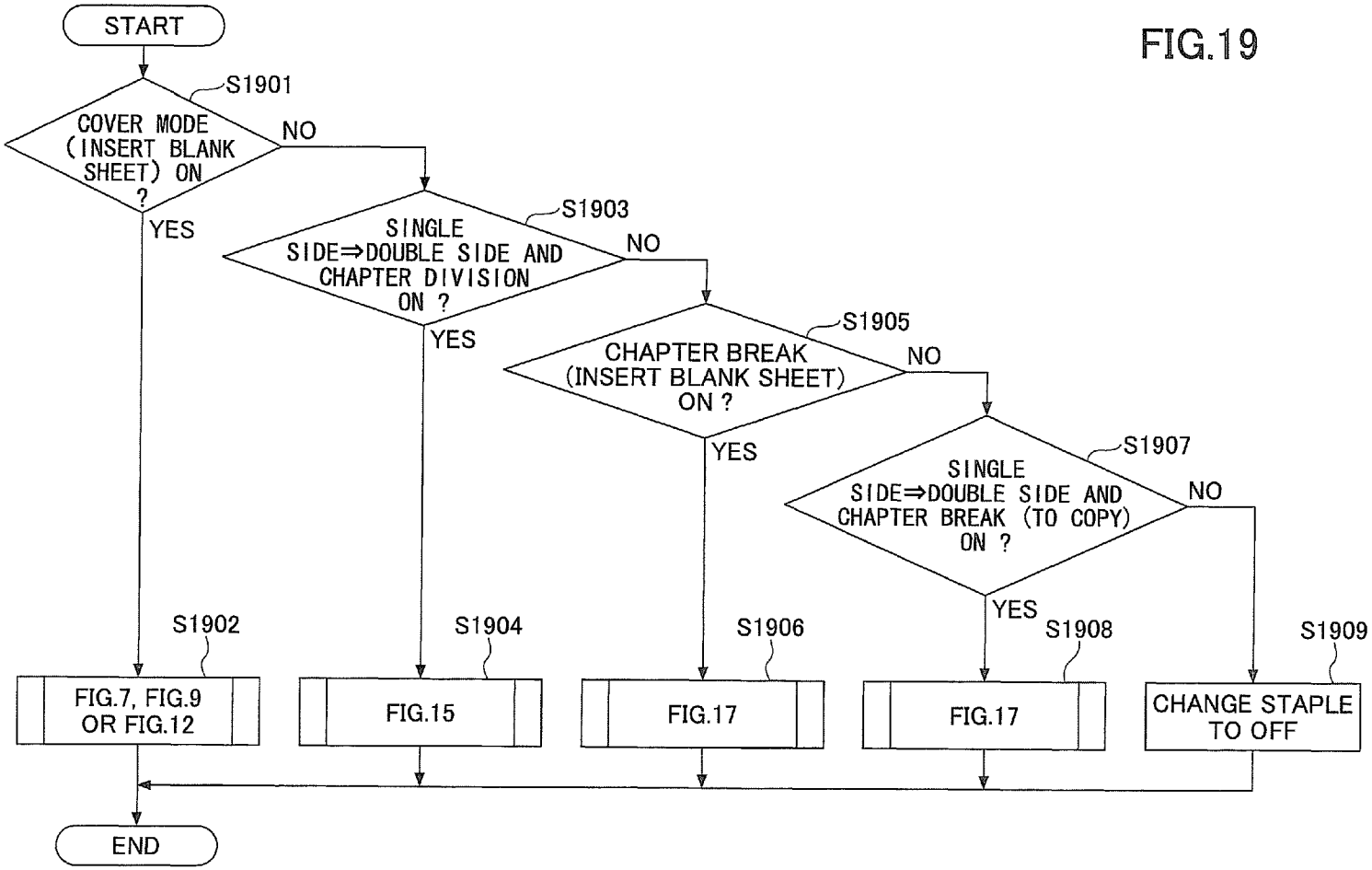
FIG. 19 is an explanatory diagram for explaining one example of other operations of the bookbinding unit of the image forming apparatus according to Example 3 of the present invention.

More specifically, as shown in FIG. 19, the image forming apparatus 150E first determines, in step S1901, whether an inserter function (a function of adding a cover) is to be used and, if the inserter function is to be used, proceeds to step S1902 (FIG. 7, FIG. 9, or FIG. 12 in Example 1). When the inserter function is not used, the image forming apparatus 150E proceeds to step S1903.

Next, in step S1903, the image forming apparatus 150E determines whether to perform chapter division in a case in which image forming of a single side manuscript is performed on a double-sided recording medium. If the chapter division is to be performed in the case in which the image forming is performed onto the double-sided recording medium, it proceeds to step S1904 (FIG. 15 in Example 2). Otherwise, the image forming apparatus 150E proceeds to step S1905.

In step S1905, the image forming apparatus 150E determines whether to add a joined paper sheet to perform chapter break. If the joined paper sheet is to be added to perform chapter break, the image forming apparatus 150E proceeds to step S1906 (FIG. 17 in Example 3). Otherwise, the image forming apparatus 150E proceeds to step S1907.

In step S1907, the image forming apparatus 150E determines whether to form the chapter beginning on the front cover side of the recording medium to perform chapter break in a case in which image forming of a single-sided manuscript is performed onto a double-sided recording medium. If the chapter beginning is formed on the front cover side of the recording medium to perform chapter break in a case in which image forming of a single-sided manuscript is performed onto a double-sided recording medium, the image forming apparatus 150E proceeds in step S1908 (FIG. 17 in Example 3). Otherwise, the image forming apparatus 150E proceeds to step S1909.

In step S1909, the image forming apparatus 150E performs updating of the information on the image forming conditions such that the post-processing is not carried out.

Thereafter, the image forming apparatus 150E carries out the same operation as the image forming apparatus 100 according to the embodiment, completing the image forming operation.

While embodiment and examples of the image forming apparatus and the image forming method according to the present invention have been described in the above, the present invention is not to be limited to the above-described embodiment and examples. Moreover, the present invention can be varied or changed in light of the claims attached.

The present application is based on and claims the benefit of priority of Japanese Priority Application No. 2012-137244 filed on Jun. 18, 2012, the entire contents of which are hereby incorporated by reference.

The invention claimed is:

1. An image forming apparatus, comprising:

a bookbinding device configured to bind multiple recording media; and a controller including a processor configured to, detect a number of manuscript sheets on which an image is formed, calculate an anticipated number of sheets of recording media on which the image is to be formed based on a print job associated with printing the image, the print job including the detected number of sheets and an additional sheet as a cover arranged on an outside of the multiple recording media which are stacked in an overlapping manner, determine whether the anticipated number of sheets calculated exceeds a set number of sheets, and instruct the bookbinding device to bind the multiple recording media by omitting the cover on the outside of the multiple recording media when performing post-processing on the print job, if the anticipated number of sheets exceeds the set number of sheets.

2. The image forming apparatus as claimed in claim 1, further comprising:

a display configured to output processing selection information on the calculated anticipated number of sheets; and an input device configured to receive input processing determination information on whether the cover is arranged on the outside of the multiple recording media, wherein the controller is configured to, instruct the display to output the processing determination information when the image is not formed on the cover, if the anticipated number of sheets exceeds the set number of sheets, and instruct the bookbinding device to bind the multiple recording media without arranging the cover on the outside after the display outputs the processing selection information and the processing determination information is input into the input device.

3. The image forming apparatus as claimed in claim 1, wherein the controller instructs the bookbinding device to bind the multiple recording media without arranging a first cover on a front outer side or a second cover on a rear outer side of the multiple recording media.

4. The image forming apparatus as claimed in claim 1, wherein the controller instructs the bookbinding device to bind the multiple recording media without categorizing the multiple recording media on which the images are formed by performing chapter division, if the anticipated number of sheets exceeds the set number of sheets when a single side of some of the multiple recording media is set to be blank in order to categorize the multiple recording media based on content of the images formed when forming the images on a single side of the multiple manuscript sheets during double sided printing.

5. The image forming apparatus as claimed in claim 1, wherein the controller instructs the bookbinding device to bind the multiple recording media by omitting a blank sheet included in a print job associated with the multiple recording media to categorize the multiple recording media by indicating chapter divisions therebetween, if the determining unit determines that the anticipated number of sheets exceeds the set number of sheets.

6. The image forming apparatus as claimed in claim 1, wherein the controller is further configured to, calculate a number of sheets at a time of aggregating the recording media for forming, on the recording media, aggregated multiple images, determine whether the calculated number of sheets at the time of aggregating exceeds the set number of sheets, and instruct the bookbinding device to aggregate the images to form the aggregated images on the multiple recording media and bind the multiple recording media, if the number of sheets at the time of aggregating does not exceed the set number of sheets and the anticipated number of sheets exceeds the set number of sheets.

7. An image forming method, comprising the steps of:

detecting, via a processor included in a controller, a number of manuscript sheets on which an image is formed;

calculating, via the processor, an anticipated number of sheets of recording media on which the image is to be formed based on a print job associated with printing the image, the print job including the detected number of sheets and an additional sheet as a cover arranged on an outside of multiple recording media which are stacked in an overlapping manner;

determining, via the processor, whether the anticipated number of sheets calculated exceeds a set number of sheets; and instructing, via the processor, a bookbinding device to bind the multiple recording media by omitting the cover on the outside of the multiple recording media when performing post-processing on the print job, if the anticipated number of sheets exceeds the set number of sheets.

8. A non-transitory computer readable recording medium comprising instructions that, when executed by a processor included in a controller of an image forming apparatus, configures the processor to, detect a number of manuscript sheets on which an image is formed, calculate an anticipated number of sheets of recording media on which the image is to be formed based on a print job associated with printing the image, the print job including the detected number of sheets and an additional sheet as a cover arranged on an outside of multiple recording media which are stacked in an overlapping manner, determine whether the anticipated number of sheets calculated exceeds a set number of sheets, and instruct a bookbinding device to bind the multiple recording media by omitting the cover on the outside of the multiple recording media when performing post-processing on the print job, if the anticipated number of sheets exceeds the set number of sheets.

* * * * *